US010294718B2

(12) United States Patent
Hicks et al.

(10) Patent No.: US 10,294,718 B2
(45) Date of Patent: May 21, 2019

(54) PULL ACROSS ROLL UP SCREEN ASSEMBLY

(75) Inventors: Craig Frederick Hicks, Eagle Farm (AU); Charles Bilek, Eagle Farm (AU); Martin Haberland, Eagle Farm (DE); Gary Drinkwater, Eagle Farm (AU); Nigel Frank Spork, Eagle Farm (AU); Glen D. Pacholke, Eagle Farm (AU)

(73) Assignee: Centor Design Pty Ltd, Eagle Farm, Queensland (AU)

( * ) Notice: Subject to any disclaimer, the term of this patent is extended or adjusted under 35 U.S.C. 154(b) by 0 days.

(21) Appl. No.: 11/884,689

(22) PCT Filed: Dec. 11, 2006

(86) PCT No.: PCT/AU2006/001876

§ 371 (c)(1),
(2), (4) Date: Dec. 7, 2007

(87) PCT Pub. No.: WO2007/068037

PCT Pub. Date: Jun. 21, 2007

(65) Prior Publication Data

US 2008/0163988 A1 Jul. 10, 2008

(30) Foreign Application Priority Data

Dec. 12, 2005 (AU) ..... 2005906969
May 26, 2006 (AU) ..... 2006902848

(51) Int. Cl.

| | |
|---|---|
| ***A47G 5/02*** | (2006.01) |
| ***E06B 9/54*** | (2006.01) |
| *E06B 9/58* | (2006.01) |

(52) U.S. Cl.
CPC ..... *E06B 9/54* (2013.01); *E06B 2009/543* (2013.01); *E06B 2009/583* (2013.01)

(58) Field of Classification Search
CPC . E06B 9/54; E06B 2009/543; E06B 2009/583
USPC ..... 160/265, 310, 122, 313, 318, 133, 31, 160/322, 170, 323.1
See application file for complete search history.

(56) References Cited

U.S. PATENT DOCUMENTS 262,398 A 8/1882 Gerald
490,448 A * 1/1893 Lugrin ..... E06B 9/40 160/120
520,065 A * 5/1894 Lugrin ..... E06B 9/50 160/122

(Continued)

FOREIGN PATENT DOCUMENTS

BE 902207 A 8/1985
CA 2027827 4/1991

(Continued)

*Primary Examiner* — Katherine W Mitchell
*Assistant Examiner* — Johnnie A. Shablack
(74) *Attorney, Agent, or Firm* — Wells St. John P.S.

(57) ABSTRACT

A pull across screen assembly has a flexible screen member (e.g. flymesh) wound about a vertical rod positioned at one side of the opening. A line member arrangement is attached to the front of the screen member and part of the line member winds about a tapered drum which is positioned on top of rod and which rotates with rotation of the rod. The arrangement allows the screen member to be tensioned and also to be balanced as it is pulled across the opening.

38 Claims, 20 Drawing Sheets

(56) References Cited

U.S. PATENT DOCUMENTS 740,929 A * 10/1903 Sapp ..... E06B 9/50 105/332
1,121,898 A 12/1914 Davis
1,134,326 A * 4/1915 Gambon ..... 160/277
1,330,447 A 2/1920 Pech
1,385,131 A 7/1921 Horn
1,546,848 A * 7/1925 Lundgren ..... E06B 9/54 109/17
1,594,812 A 8/1926 Blackburn
1,760,612 A 5/1930 Trott
1,936,251 A * 11/1933 McCullough ..... B60J 1/2025 160/265
2,013,500 A * 9/1935 O'Connor ..... 248/269
3,386,489 A * 6/1968 Denton et al. ..... 160/25
4,406,519 A 9/1983 Shaw
4,691,753 A * 9/1987 Baier ..... 160/32
4,819,295 A 4/1989 Kaftan
4,823,859 A 4/1989 Park
5,390,596 A 2/1995 Farr
5,456,303 A * 10/1995 Horinouchi ..... E06B 9/0692 160/84.04
5,477,904 A * 12/1995 Yang ..... B60J 1/2091 160/370.23
5,515,898 A * 5/1996 Alcocer ..... B64C 1/1484 160/265
5,522,314 A 6/1996 Newman, Jr.
5,659,999 A 8/1997 Benson
5,758,704 A 6/1998 Elrod
5,799,715 A * 9/1998 Biro ..... E06B 9/322 160/170
6,209,614 B1 4/2001 Smoot
6,283,192 B1 * 9/2001 Toti ..... E06B 9/30 160/170
6,682,133 B2 * 1/2004 Glasl ..... B60J 7/0015 160/370.22
6,742,565 B2 6/2004 Badley
6,938,666 B1 * 9/2005 Ulriksen et al. ..... 160/98
7,710,646 B2 5/2010 Stewart et al.
8,056,601 B2 * 11/2011 Kirby ..... E06B 9/42 160/265
8,235,085 B2 * 8/2012 Coleman ..... E06B 3/94 160/199
8,905,468 B2 * 12/2014 Kitani ..... B60J 7/0015 160/265
9,290,990 B2 * 3/2016 Hicks ..... E06B 9/54
9,587,430 B2 * 3/2017 Colson ..... A47H 2/00
9,593,529 B2 * 3/2017 Haberland ..... A47H 11/06
9,689,201 B2 * 6/2017 Riemelmoser ..... E06B 3/4609
9,739,088 B2 * 8/2017 Hicks ..... E06B 9/40
2001/0042346 A1 * 11/2001 Brioschi ..... E06B 9/54 49/447
2004/0154758 A1 * 8/2004 Cheng et al. ..... 160/170
2005/0051283 A1 * 3/2005 Chatellard et al. ..... 160/265
2005/0077017 A1 4/2005 Ramsey
2005/0161175 A1 * 7/2005 Tussinger ..... 160/265
2006/0090858 A1 5/2006 Heidenreich
2008/0062516 A1 3/2008 Stewart et al.
2008/0163988 A1 7/2008 Hicks et al.
2014/0130992 A1 * 5/2014 Clephas ..... B60J 7/0015 160/323.1
2017/0130527 A1 * 5/2017 Riemelmoser ..... E06B 3/4609
2017/0211325 A1 * 7/2017 Riemelmoser ..... E06B 9/54

FOREIGN PATENT DOCUMENTS

CN 2237105 10/1996
DE 3936913 5/1991
DE 19807541 7/1999
EP 0207040 A1 12/1986
EP 0 429 898 A2 6/1991
EP 0911476 4/1999
EP 0911476 B1 9/2002
EP 0911476 B1 9/2002
EP 07718977 11/2012
EP 13179466 12/2013
FR 2546226 11/1984
FR 2558518 7/1985
FR 2563860 11/1985
FR 2594173 A1 8/1987
FR 2 686 372 A1 7/1993
IN 3233/CHENP/2008 2/2015
IN 8246/CHENP/2008 11/2016
JP 9303068 11/1997
JP 10072988 3/1998
WO 1987/004485 7/1987
WO PCT/AU2007/000731 5/2007
WO PCT/AU2007/00731 2/2008
WO PCT/AU2007/00731 5/2008

* cited by examiner

PULL ACROSS ROLL UP SCREEN ASSEMBLY

RELATED PATENT DATA

This application is a 35 U.S.C. § 371 application of and claims priority to International Application Number PCT/AU2006/001876, which was filed Dec. 11, 2006, and which claims priority to Australian Application No. 2006902848, filed May 26, 2006, and to Australian Application No. 2005906969, filed Dec. 12, 2005, the teachings of which are incorporated herein by reference.

FIELD OF THE INVENTION

This invention is directed to a screen assembly that can be used in a window or door cavity, or any other area which may benefit from the assembly and which contains a flexible sheet like member (for instance an insect screen) which can be pulled across the window or door cavity. The invention is particularly directed to a screen assembly as described above where the flexible sheet like member is wound about a rod (for example), and where the rod is positioned substantially vertically such that the screen extends and retracts in a horizontal direction.

BACKGROUND ART

It is well known to provide a roll up, or retractable, screen assembly that can extend across a window or door. In most cases, a flexible screen can be wound about a wooden, metal or plastic rod or pole which is positioned in a substantially horizontal manner such that the screen assembly can be pulled up or pulled down in a vertical direction. A holland blind is an example of this type of screen assembly.

It is also known to provide a retractable screen assembly that can move in a horizontal direction across a window or door cavity, and with this type of assembly, the screen (for instance a mesh) can be wound about a substantially vertical rod or pole (typically located at one side of the cavity).

The present invention is directed primarily to a screen assembly that can move horizontally across a window or door cavity. However, there may be parts of the invention which may find suitability in "up and down" screens or screens which are extended and retracted in other manners.

There is a general requirement that the flexible screen is placed under tension to keep it relatively taut when pulled from the retracted position to the extended position. For vertically moving (that is up and down moving) screen assemblies, this can be quite easily achieved by providing some type of weight on the bottom edge of the screen. However, for horizontally moving screen assemblies, this cannot be easily done. Also, it is not satisfactory to simply turn a vertically moving screen assembly on its side to make a horizontally moving screen assembly. For instance, one disadvantage is that gravity cannot be used to tension the screen material (as is the case with vertically moving screens). Another disadvantage is that the screen material has a tendency to sag as it is pulled across which is unsightly and can create gaps and openings and damage to the mechanism.

A known solution to provide tension with horizontally moving screen assemblies is to provide some form of spring to maintain tension in the screen material. The spring can be placed within a hollow tube about which the screen material is wound. Extension (unrolling) of the screen material from the tube causes the spring to be increasingly "wound up" to create tension (a "pullback" force) in the screen material.

A disadvantage with this arrangement is that the amount of tension increases as more of the screen material is unwound from the tube. This means that it can become progressively more difficult to pull the screen material further across the window or door cavity from one side to the other. It should be appreciated that one use of the screen assembly is across rather large door cavities that can have a length of between 3-6 m, and usually contain bifold doors or multi-sliding doors. Thus, it can become very difficult to pull a screen across the door cavity as the tension can become too large—especially with a single screen spanning 3 meters or more. If the tension is reduced to compensate, the screen material can sag due to insufficient tension, or have sag lines.

Another disadvantage with the above type of arrangement, is that once the screen has been pulled across, and latched or otherwise connected to the other side of the door or window cavity, if the screen is unlatched, it can retract very quickly to the other side of the door or window cavity which is quite unsuitable.

Another disadvantage with the above type of arrangement, is that the increasing tension can cause damage (for instance premature stretching) of the screen material, especially if the screen material is relatively flimsy. There is an advantage in having screen material which is relatively thin (and therefore may be somewhat flimsy), as it allows a greater length of material to be wound about the tube without making the diameter to large to be neatly hidden away in one side of the cavity.

An attempted solution to this problem has been to introduce some form of brake. However, any form of brake can increase the number of parts in the assembly, and require constant maintenance and possible replacement, can fail under wet conditions or if debris or grime come into contact with the brake, and therefore the concept of having some form of brake is generally undesirable It is also known to try to balance the tension on the screen, in essence, to try to reduce the increasing tension force as the screen is pulled across the window or door cavity. Various arrangements of counterweights have been tried to provide some type of balance to the tension force. These counterweights may comprise a weighted rod attached to the end of a line member. Other arrangements use various types of "counter" spring arrangements to provide a balance.

A disadvantage with the use of counterweights is the problem with inertia. To explain, when the screen is in the extended position, and typically pulled across the window or door cavity and latched to the other side, if it is desired to open the screen by pulling the screen partially back away from the other side of the window and door cavity, doing so will cause acceleration or deceleration of the counterweights, and the consequence of this is that the screen will always feel "heavy" to operate quickly which is quite undesirable. Thus, the use of counterweights, and particularly the very large and heavy counterweights may not be a general solution to overcome the problem with all types of screens, but the present invention may be able to accommodate some form of counterweight.

A disadvantage with the use of a "counter" spring is that the spring can only produce a complete neutralisation or balance of the tension at only one extended position. Put differently, with the use of a counter spring, the screen can be pulled across and pulled back more easily than without a counter spring, but if the screen is let go, the "balance" position will be somewhere across the door or window cavity. While this arrangement has some advantages, there is still the general disadvantage that there will always be some resistance to movement of the screen across the window or door cavity except at the one particular "balance" point. It is generally not possible to vary the counter spring in a continuous manner such that the screen is always balanced no matter where the screen is across the door cavity.

It is also known to provide a screen that can be pulled across a door or window or other type of cavity and where there is also provided a line member and pulleys etc to assist in the extension and the retraction of the screen. For a horizontally extending screen, it is known to have a vertical rod, typically at one end of the cavity, and about which to screen material can be wound/unwound, and pulleys or similar devices at the other end of the cavity, with a line member (typically a steel wire, plastic wire etc) connecting the various parts.

It is also known to provide a horizontally extending screen where the screen material wraps around a vertical support member, and where the vertical support member is hollow, and a spring is provided in the vertical support member. A disadvantage with this arrangement is that if the spring requires adjustment, is quite difficult to access the spring to do so.

Therefore, there would be an advantage if it were possible to have a screen assembly containing some form of biasing means or spring and where the spring is not situated within the supporting member.

There is an advantage in being able to provide a mechanism that can substantially balance the tension force of the screen at any position across the door window cavity such that, if the screen is let go at any position, the screen will simply remain still and will not retract or further extend, and where the mechanism is reliable in operation.

There is also an advantage is being able to provide a mechanism generally as described above and which is relatively simple in manufacture and design.

Referring again to the screens that have a single "balance" point, there is sometimes an advantage in providing a screen assembly, and typically a "pull across" screen assembly which is relatively easy to manipulate and which has at least one balance point, and which, when positioned somewhat away from the balance point, will naturally move back to the retracted position or naturally move forward to the extended position. Thus, there may be an advantage in having a screen assembly which is not balanced at each and every point of extension but which is balanced at some point, and "partially" balanced at other points by which is meant that at these other points, the screen will slowly either retract or extend. An advantage of this assembly (and in contrast to some existing assemblies) is that there is little likelihood of the screen retracting or extending very quickly, because the screen is partially balanced.

There would also be an advantage if it were possible to provide a screen assembly which can also have some form of adjustment means to compensate for irregularities in the shape of the door cavity.

Many known types of pull across (horizontally extending) or up-and-down (vertically extending) have some sort of mechanism to balance the screen. It is known to use a tapered drum or frusto conical pulley to "tune" the drum to the width of the roll of screen material on the rod. U.S. Pat. No. 262,398 [1882] describes such an arrangement.

To provide smooth operation of the screen, a drum/pulley is placed on each end of the horizontal rod (for an up-and-down) motion or on the upper and lower end of a vertical rod (for a pull across screen). US 2005/0051283, EP911476, FR 2594173, JP9303068, FR2558518, DE3936913, and CA 2027827 describe such dual drum/pulley arrangements.

A disadvantage with these dual drum arrangements, is that they are generally not suitable for use with a vertical rod in a pull across screen, as the lower drum must be recessed into the floor/ground which is not desirable, as the drum is prone to damage, may be a tripping hazard, looks unsightly, and can accumulate dirt and debris which can effect the proper operation of the drum.

FR 2563860 describes a pull across screen comprising only an upper drum, but to ensure smooth operation, a motor is used to operate the screen.

Therefore, there would be an advantage to provide a pull across screen which does not require a lower drum and which can be extended or retracted in a balanced manner and which has a particular line and spring arrangement to enable this to occur. The screen can be operated manually, and it is not essential to have a motor (although a motor can be used if desired).

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide a screen assembly that comprises a horizontally movable screen (that is the screen that can move across an area) and where the screen can be substantially balanced at a plurality of positions, or at all positions or at substantially all positions.

A further optional object of the invention comprises a screen assembly substantially as described above and where the screen can be substantially balanced at, at least one position, and where the screen is "partially" balanced at other positions.

The object of the invention may be achieved by a special design of some of the components of the screen assembly to enable a "continuous" balance to be achieved, or at least a balance to be achieved at multiple positions of the screen.

In one form, the invention comprises a screen assembly that can move across a cavity or opening and the like, the screen assembly comprising a screen that is made of flexible material, a supporting member about which the screen can be wound/unwound, the supporting member typically being arranged in a substantially vertical manner, and typically being positioned adjacent one end of the cavity/opening etc, a means (typically a spring) to create a tension in the screen, a drum, or line operating member, a line member that can be wound onto and off the drum, or which can be operated by the operating member, the line member being operatively associated with the screen such that as the screen is extended, the line member is wound onto the drum, or, pulled onto the operating member, and as the screen is retracted, the line member is wound off the drum, or is removed from the operating member, the screen, when wound about the supporting member, having a diameter which increases as more of the screen material is wound about supporting member, and which decreases as the screen material is unwound from the supporting member, and wherein the diameter of the drum, or the operating member at the position where the line member lines onto the drum or off the drum, or the operating member, is about the same diameter of the supporting member containing the screen.

In another form there is provided a screen assembly comprising a flexible screen [10, 2] having a front edge area [13, 8], a supporting member [11, 6] about which the screen can be wound/unwound and which is substantially vertical and has an upper end and a lower end, a biasing means [14, 3, 3*a*, 3*b*] to create a tension in the screen, a drum/pulley [1, 12] associated with at least one end of the supporting member, a line member [5, 16,] that can be wound onto and off the drum/pulley, the line member being operatively associated with the screen such that as the screen is extended, the line member is wound onto the drum/pulley, and as the screen is retracted, the line member is wound off the drum/pulley, the screen, when wound about the supporting member, having a diameter which increases as the screen material is wound about supporting member, and which decreases as the screen material is unwound from the supporting member, the diameter of the drum/pulley, at the position where the line member winds onto the drum/pulley or off the drum/pulley, being about the same diameter of the supporting member containing the screen, the line member being operatively attached to the front edge area of the screen.

The term "operating member" may include a drum, but need not do so and may also include a cog, gear member, sprocket and the like and particularly a member where the cog, gear member, sprocket and the like has a spiral or helical shape and a varying diameter. In this version of the invention, the line member need not be wound onto or off the operating member. Instead, the operating member could simply extend or retract the line member over the, or part of the operating member and into a collection box or container or something else. This arrangement may find particular suitability if the line member comprises a chain, and the like.

A feature of the present invention is to "tune" the drum diameter to be about the same as the diameter of the screen about the supporting member. Thus, as the screen is unwound, and the diameter decreases, the diameter of the drum, where the line member is wound onto the drum also decreases, to be about the same diameter. Conversely, as the screen is wound back onto the supporting member, and the diameter increases, the diameter of the drum where the line member is unwound from the drum also increases.

A similar arrangement is possible if an operating member is used. For instance, the operating member may comprise a spiral cog or something similar and the "diameter" of the operating member can be "tuned" to be about the same as the diameter of the screen/supporting member at the place where the line member extends about or onto the cog.

This particular feature enables the screen to be "balanced" at almost every point of extension and retraction which means that a person feels no resistance from the mesh tension at any position during operation of the unit. It also enables the screen material to have considerable tension to minimise sagging.

By "tuning" the diameter of the drum line to the diameter of the screen/supporting member, the forces seem to be quite balanced which means that it is relatively easy to pull the screen across the cavity without feeling an increased pull-back force from the spring, and if the screen is let go, it will stay in position or possibly move only quite slowly.

One way by which the "tuning" can be achieved is to have a drum which has a conical shape, or where part of the drum has a conical shape, such that as the line member is wound onto, or off the drum, the diameter at the position where the line member contacts to drum will vary, and by designing a conical shape with regard to the diameter of the retracted screen, it is possible to have the two diameters to be approximately the same at all times.

Another advantage of the present invention is that by varying the shape of the drum, the operation of the screen can be varied. Thus, rather than needing to completely redesign the assembly for each use, it may be possible to do so by changing the drum.

The drum (or operating member) can have a simple conical profile, or a more complicated profile which may have cone shaped portions which may diverge or converge, cylindrical portions, other shapes, combination of shapes and the like. This may allow the screen to have places where the screen is "balanced" and other positions where the screen can slowly open or close; places where the screen may have increased or decreased tension as the screen is moved and the like.

As examples, the drum may comprise multiple cylinders of different diameters to provide a "stepped" profile, or a tapered cone at either end optionally with a short parallel portion at or adjacent the centre, the shape of a "reverse barrel", or substantially cylindrical. It should be appreciated that these are examples only of the drum and it is not considered that the invention should be limited only to these examples.

Typically, the drum will be attached to, or relative to one end of the supporting member, and it is preferred that the drum is attached to, or relative to an upper end of the supporting member. It is also preferred that the drum tapers outwardly from a narrower diameter closest to the supporting member, to a larger diameter, although this can be reversed if desired.

There may be circumstances where it may be expedient to have the drum at some other position rather than directly attached to one end of the supporting member. For instance, the drum may be positioned adjacent the supporting member, or somewhere else, and operatively attached relative to the supporting member by some form of connection means. The connection means may comprise a gear, a belt, a chain, links and the like.

The screen may comprise a mesh screen, a reflective material, and insulating material, a see-through material, a dark material, combinations and the like. The screen may be made of any suitable material including woven or nonwoven fabrics, plastics, flexible metals (for instance aluminium foil), laminated materials, bonded materials, reinforced materials, and the like. The screen may be made of a single material, a combination of materials, may be made of a single sheets, or a plurality of sheets that are attached together, and it is not considered that any particular limitation should be placed on the invention by the selection of the screen type. There may be circumstances where the screen comprises a plurality of elongate members which may be somewhat rigid and which are foldably or hingedly attached to each other such that the screen can still be rolled.

The screen will typically extend across a window or door opening and will therefore have dimensions to suit. It is also envisaged that the screen may be used in any area which would benefit from such an assembly and not necessarily limited to a window or door opening. The screen will typically have a height of between 1-3 m, and may have a length of between 1-8 m and 1-5, as either a single or double unit.

The screen assembly can function as an insect screen, a blind, an awning and the like.

The supporting member about which the screen is wound/unwound may comprise any suitable member such as a rod, a tube, and the like. The length of the supporting member will typically be dependent on the height of the cavity or opening, in which the assembly will be fitted and is expected that a suitable length will be between 1-3 m. The supporting member may be made of any suitable material such as plastic, wood, metal, composite materials and the like. The diameter of the supporting member can vary but it is expected that the diameter will be between 1-20 cm.

Although it is envisaged that the supporting member will be generally cylindrical, under some circumstances, the supporting member may have a polygonal cross-section such as rectangular, octagonal etc. It is envisaged that the supporting member will be made of a single length of material, although, if considered expedient, the supporting member may be made of a plurality of lengths which are connected together. It is also considered that supporting member may be extendable if desired (for instance telescopic). It is also considered that the term "supporting member" should include anything which can support the otherwise flexible screen material.

A means may be provided to provide tension in the screen material. The means may comprise a spring. The spring may comprise a tension spring, a torsion spring and the like. If desired, a plurality of biasing means may be provided which may be connected together or relative to each other or not connected relative to each other. The biasing means may comprise an elastomeric member. The biasing means may be provided adjacent the "free edge" of the screen (the free edge being the edge that is pulled across, as opposed to the edge that is attached to the supporting member). However, it is envisaged that the biasing means may be provided at any other position which may be convenient for installation, inspection, use, manufacturing convenience and the like.

As nonlimiting examples, the biasing means may comprise a pair of springs positioned in a suitable stile at the free end of the screen. Alternatively, a single spring may be provided. In a further alternative, the biasing means may be provided adjacent an edge of the "cavity" in which the assembly is used and thus not necessarily in a suitable stile at the free end of the screen. In another nonlimiting invention, tension can be obtained by using a counterweight instead of the spring or in addition to a spring.

If a drum is provided about which a line member can be wound/unwound. The drum may comprise a "winding" pulley, and unless the context dictates otherwise, the term "drum" is meant to include any device or item about which the line member can be wound and unwound. The drum may be made of any suitable material such as plastic, metal, wood and composite materials. The drum may be solid or hollow or contain voids and the like. It is preferred that the drum is positioned adjacent the supporting member, and in a particularly preferred embodiment, the drum is attached to the supporting member. It is also preferred that the drum is positioned adjacent an upper end of the supporting member. However, it is envisaged that the drum may be provided at any other position which may be convenient for installation, inspection, use, manufacturing convenience and the like. The size of the drum may vary inter alia depending on the length of line material and the size of line material (e.g. diameter) which is to be supported by the drum. However, it is envisaged that the drum will typically have a length of between 1-30 cm and a maximum diameter of between 3-20 cm.

The outer surface of the drum may be profiled to facilitate placement of the line member about the drum. Thus, the outer surface of the drum may contain grooves, recesses, guide means and the like to facilitate winding and unwinding of the line member.

In order to "tune" the diameter of the drum (where the line winds onto and off the drum) with the diameter of the supporting member+screen material, is considered expedient to vary the diameter of the drum along the length of the drum. Thus, it is preferred that the drum has a tapered configuration and comprises a conical shape. The amount of taper will depend on the various parameters including the thickness of the screen material, the thickness of the line member and the like. This will be described in greater detail below. It is envisaged that the drum will be uniformly tapered along its length, however this may vary and the drum may have a portion which is tapered (cone like), and another portion which is not. It is also envisaged that the drum may have more than one portion which is tapered.

It is preferred that the screen assembly contains a single drum positioned in an upper part of the screen assembly, and this is possible with the present invention and does away with the need for an upper and lower drum and the like.

A line member is provided that can be wound onto and off the drum. The line member may comprise any suitable material such as steel, plastic, composite materials and the like. It is envisaged that the line member will be substantially circular in cross-section although it is envisaged that the line member may also be substantially flat (e.g. a strip or strap), oval in cross-section and the like. The line member may comprise a wire, a "rope", a laminate of material, a chain, a cable and the like. One end of the line member may be fixed to the drum. Alternatively, the line member can engage with the drum or operating member and then pass into a container/box/cavity and the like. This alternative may find particular suitability with a chain and cog arrangement. The line member may also comprise a "ball chain" which is a cord with balls attached at spaced apart intervals.

To enable the screen assembly to allow tension in the screen material and using a relatively simple spring, a counteracting force can be applied using the line member and an arrangement of pulleys etc.

Thus, the screen assembly may comprise the drum positioned adjacent one end of the cavity and adjacent the supporting member which supports the screen, a first return pulley adjacent the upper end of the other end of the cavity, a second pulley adjacent the front edge of the screen, a biasing means adjacent the front edge of the screen, a said line member extending from the drum and about the first return pulley and about the second pulley and attached to, or relative to the biasing means, and a second line member which is joined to the first line member in between the drum and the first return pulley, the second line member extending about the first return pulley, a third return pulley adjacent the lower end of the other end of the cavity, and a fourth pulley adjacent the front edge of the screen, the second line member extending about the third return pulley and the fourth pulley and attached to the biasing means.

However, it is not considered that the invention should be limited to the arrangement of pulleys at separate described above. Further nonlimiting variations are illustrated in the accompanying figures.

It is preferred that the front edge of the screen contains some form of elongate housing (typically vertical) in which the second in the fourth pulleys can be hidden, and which also contains the biasing means. The housing may also contain a latch etc to latch against the other end of the cavity.

BRIEF DESCRIPTION OF THE DRAWINGS

Embodiments of the invention, will be described with reference to the following drawings in which.

BEST MODE

Figure 1:
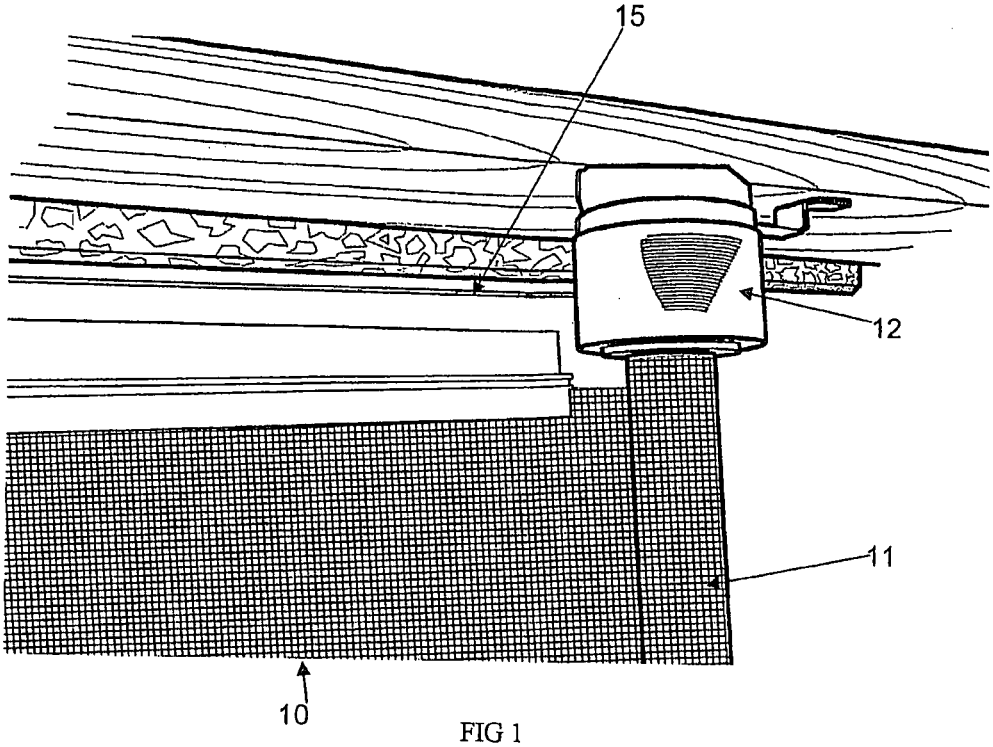
FIG. 1. Illustrates an upper portion of the screen assembly particularly illustrating the drum and the screen fully extended.
Figure 2:
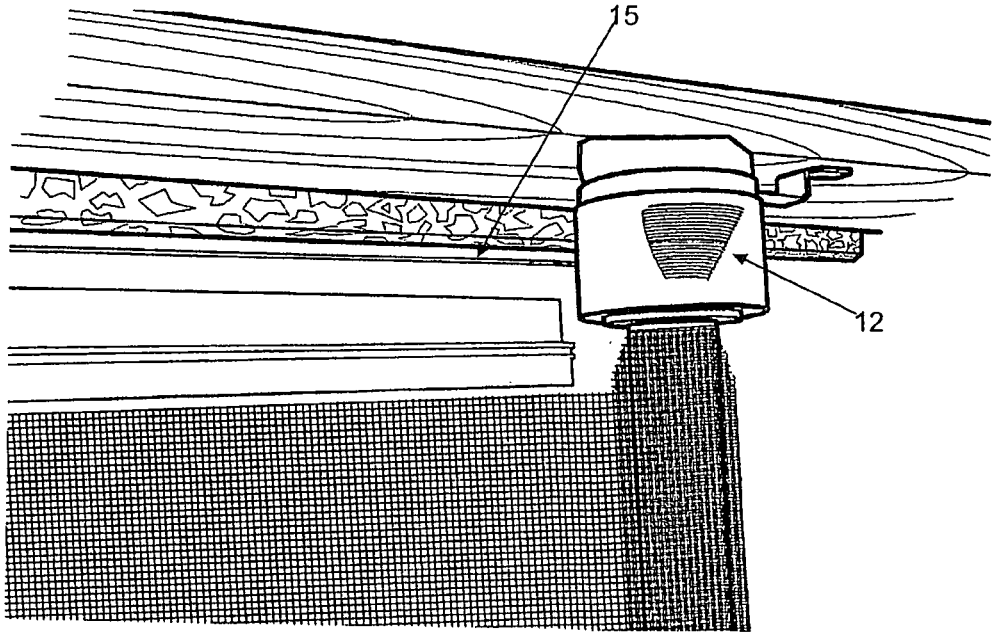
FIG. 2. Illustrates the view of FIG. 1, with the screen partially extended.

In the various embodiments, If the same reference numeral identifies different parts in the different embodiments, that reference numeral refers only to the part in the particular embodiment.

Figure 3:
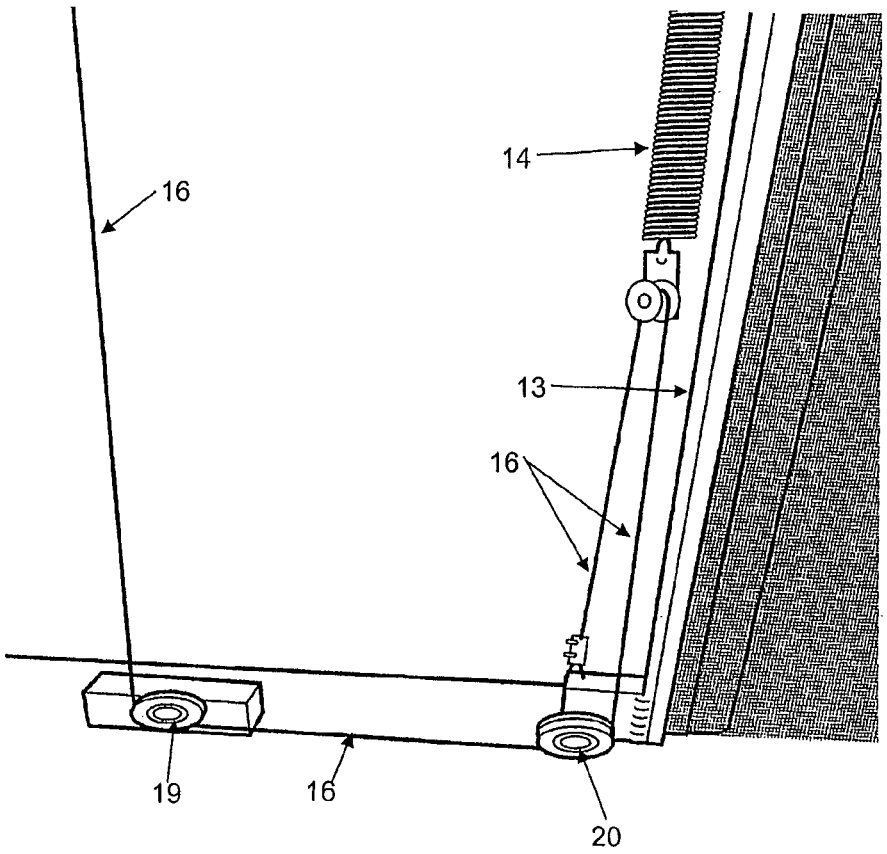
FIG. 3. Illustrates a lower portion of the front edge of the screen and particularly illustrating the third pulley, the fourth pulley and the lower end of the biasing means (the housing being removed on the front edge of the screen for clarity).
Figure 4:
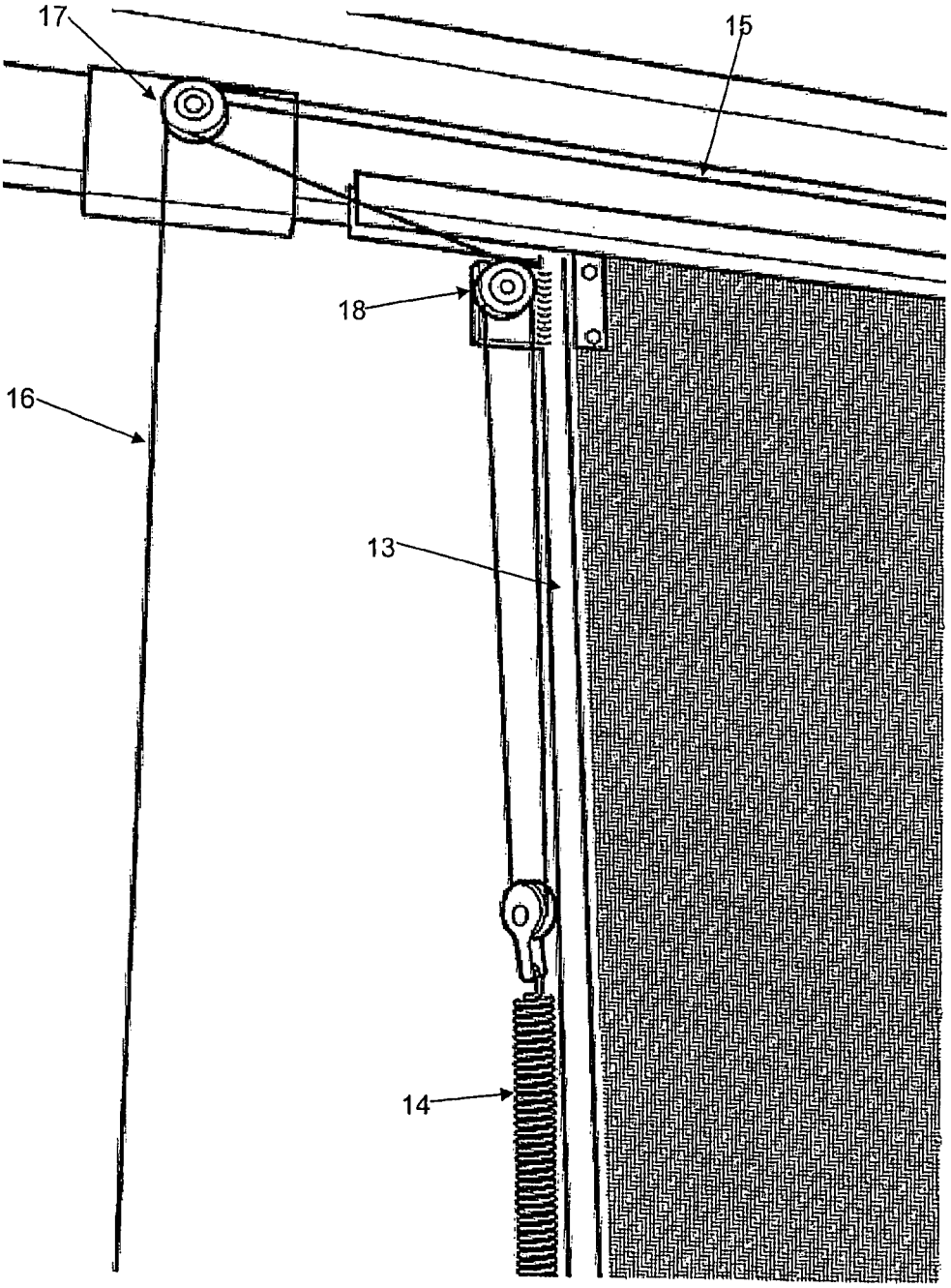
FIG. 4. Illustrates an upper portion of the front edge of the screen and particularly illustrating the first return pulley and a second pulley and an upper part of the biasing means which is adjacent the front edge of the screen.
Figure 5:
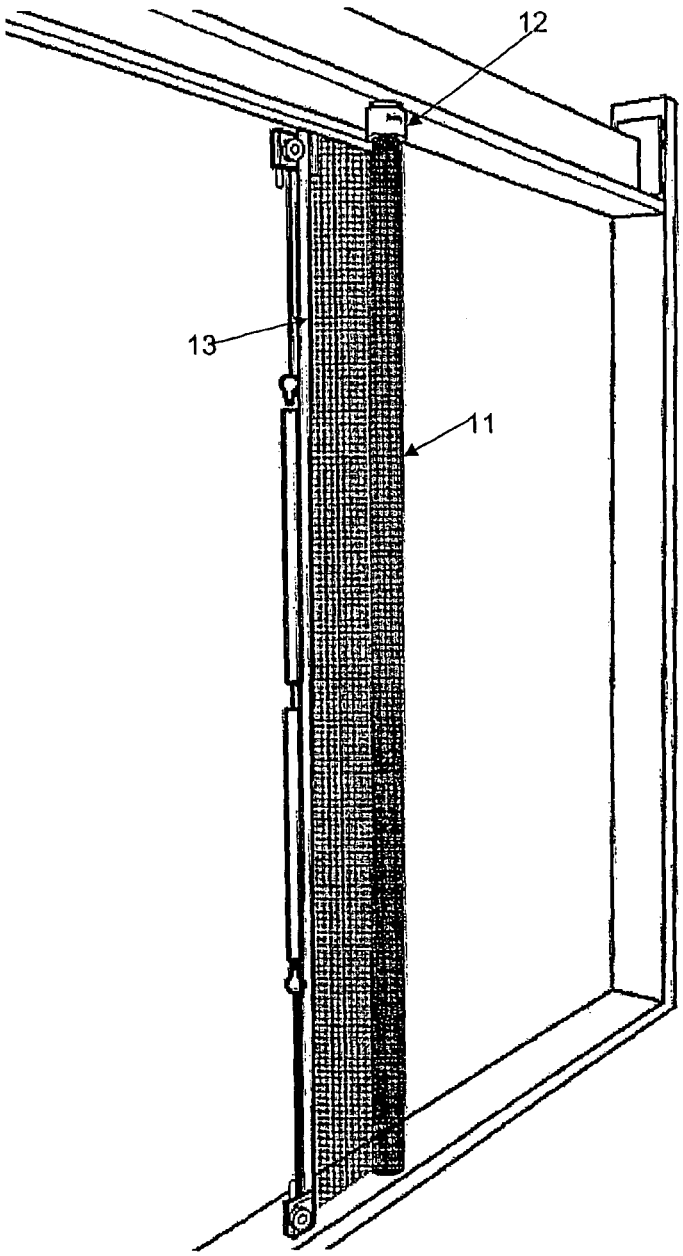
FIG. 5. Illustrates the screen in the retracted position.
Figure 6:
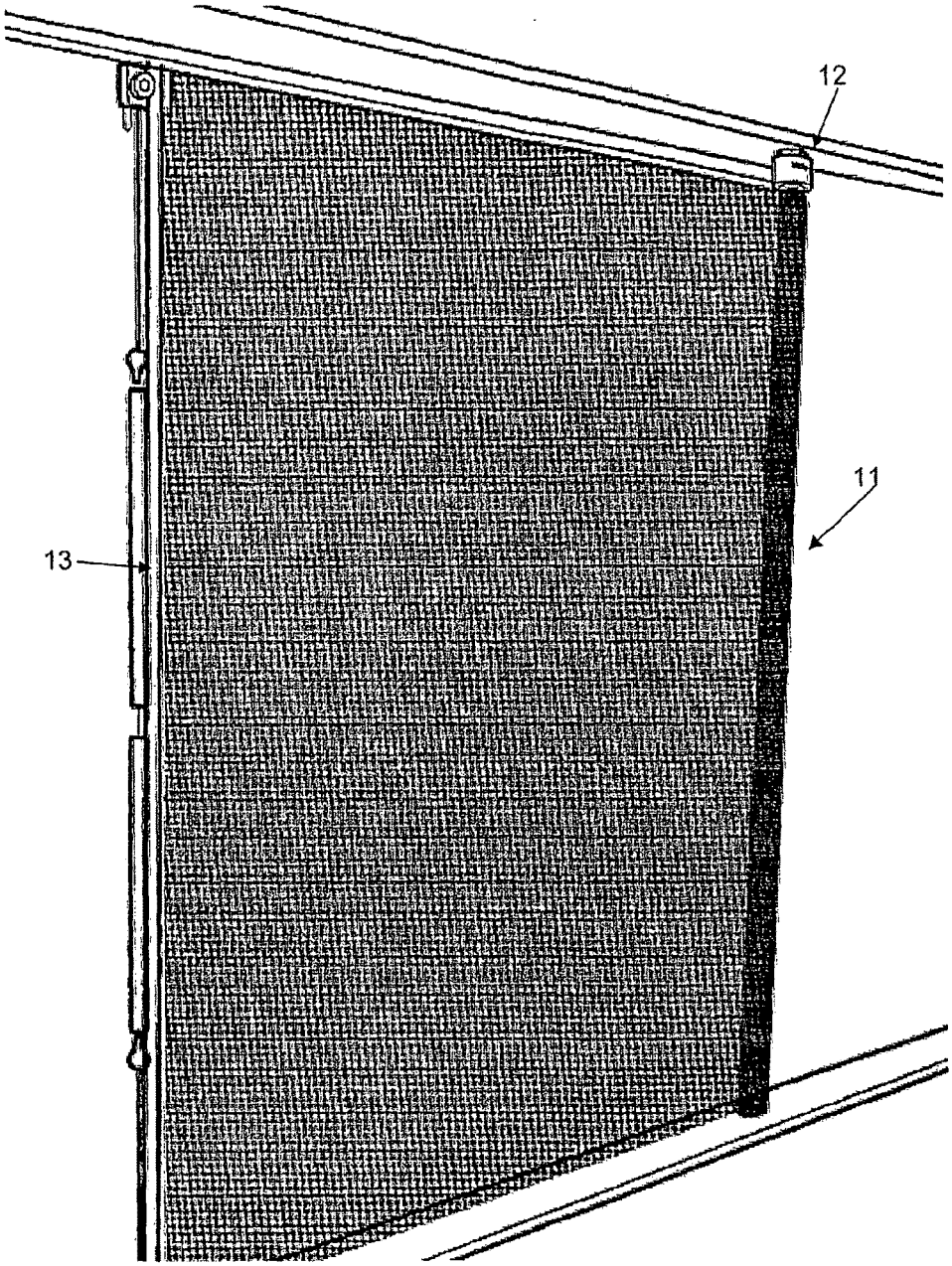
FIG. 6. Illustrates the screen in the approximately half extended position.

Referring to FIGS. 1-6, the screen assembly according to the particular embodiment basically comprises the following components:—A screen 10, which in the particular embodiment comprises an insect screen, a supporting member 11 about which the screen is wound and unwound, a drum 12 which is positioned in an upper part of the assembly and on top of supporting member 11, a front edge 13 of the screen 10 and which is made of an elongate aluminium section, a biasing means 14 (the lower portion being visible in FIG. 3, and the upper portion being visible in FIG. 4), the biasing means being attached to front edge 13, a line member which is split into a first line member 15 and a second line member 16 (this will be described in greater detail below), a first return pulley 17 (FIG. 4), a second pulley 18 (FIG. 4), a third return pulley 19 (FIG. 3) and a fourth pulley 20 (FIG. 3).

There are many advantages to this arrangement. One advantage is that the screen can be "balanced" at a plurality of positions (and indeed it may be balanced substantially continuously) as the screen is extended and retracted. Another advantage in the particular embodiment is that the biasing means (in this case springs) is not positioned in the supporting member, but instead can be positioned within or next to the front edge 13.

Screen 10, and the particular embodiment, can be extended between 2-5 m and therefore has this length at least. One end of the screen 10 is attached to the supporting member 11. Supporting member 11 is mounted for rotation about its longitudinal axis such that the screen 10 can be wound and unwound from the supporting member. Importantly, as screen 10 is wound or unwound from the supporting member, the diameter (this being the diameter of the supporting member+any attached screen material) will vary, and will decrease as the screen is unwound and will increase as the screen is wound.

Attached to the top of supporting member 11 is drum 12. In the particular embodiment, drum 12 has a tapered face and is therefore substantially conical. The taper goes from a smaller diameter adjacent the top of the supporting member 11 to a large diameter. It is envisaged that the drum may also be positioned the other way as well. The length of the drum is approximately 3 cm. The widest part of the drum (in the particular embodiment) will be approximately the same diameter as the widest diameter of the supporting member 11+screen 10 (that is when the screen is fully wound on the drum and is completely retracted), and the narrowest part of the drum (in the particular embodiment) will be approximately the same diameter of the diameter of the supporting member+any remaining screen 10 when the screen has been fully extended, and unwound from the drum.

The first line member 15, which in the particular embodiment comprises a plastic coated steel wire having a diameter of between 1-3 mm, has one end attached to the drum. Therefore, rotation of the drum will cause line member 15 to wind on to the drum or off the drum as the case may be. In the particular embodiment, and because of the cone shape of the drum, the line member will be laid next to each other on the drum. Thus, the diameter of the drum at the point where the line member is wound onto or off the drum will vary because of the conical shape of the drum.

The first line member 15 extends from drum 12 and extends about first return pulley 17 and then about second pulley 18 and is ultimately attached to the upper part of the biasing means 14 which in the particular embodiment comprises a spring. Thus, there is tension in the first line member 15. A second line member 16 is also provided which is formed from the same material as first line member and second line member 16 has one end which is joined to first line member (and therefore branches therefrom) in between drum 12 and first return pulley 17. Second line member 16 then also extends about first return pulley 17 but then extends substantially vertically to extend about third pulley 19, then fourth pulley 20 and is attached to the lower end of biasing means 14. Thus, there is tension in second line member 16.

The biasing means 14, and second pulley 18 and third pulley 19 are all attached to or relative to the front edge 13 of the screen and therefore move with the screen.

In use, as the screen is extended, the first line member will be wound about and onto drum 12. In the particular embodiment, as the line winds onto the drum the line progressively winds from the larger diameter of the drum to the narrower diameter of the drum and therefore the diameter reduces where the line is wound onto the drum. This can be seen with reference to FIG. 1 and FIG. 2. At the same time, the diameter of the support member 11 containing the wound up screen material 10 will decrease as the screen material is unwound, and the construction and arrangement is such that the diameter of the drum is about the same at any one point as the diameter of the support member+any remaining screen material. This will also be the case when the screen is retracted as this will cause the diameter of the support member+screen material to increase and at the same time the line member is being unwound from the drum at progressively increasing diameters.

It is found that this assists in allowing for balancing tension to be applied at all time. The drum enables a constant length of screen to be on a roll (supporting member) at all times thereby largely eliminating the need to allow for a change in length deployed in the system. The use of a spring as opposed to counterweights can reduce the system inertia.

Further embodiments of the invention or further clarification of existing embodiments of the invention is given below:

FIG. 7

Preferred Embodiment of Single Unit.

A line member is attached to a biasing member (e.g. a tension spring) contained in either end of the moveable vertical stile, in this embodiment, line member 5*a* is attached to biasing member (3*a*), and line member (5*b*) is attached to biasing member (3*b*). The pretension force applied by each extended biasing member (Force A from the top member and Force B from the bottom member) is transferred to the respective line members (5*a* and 5*b*), which are taken around pulleys (7) at one end of the aperture to be screened. Each pulley (7) includes a pair of guides, each guide for guiding line members 5*a* and 5*b*. The guides maintain the line members (5*a* and 5*b*) spaced apart and parallel to one another around the pulley (7). The two line members (5*a* and 5*b*) are attached to a joiner block (4) and a third line member (5) (or alternatively either 5*a* or 5*b* could extend through the joiner block (4)) is attached to the other side of the joiner block. The joiner block mounts the two line members (5*a* and 5*b*) spaced apart and parallel from one another. Force C in line member 5 is equal to the combined forces A&B and the other end of this line member 5 is attached to a drum or spooling member which is fixed to the top end of a rod (6) onto which the flexible membrane (2) is rolled.

As the stile (3) is moved away from the rod (6), the flexible membrane is unrolled from the rod (6) and at the same time the line member (5) is wound onto the drum (1). The tension (Force C) in the line member (5) is applied to the drum (1) causing a resultant torque. In a perfectly balanced system, if the effective diameter of drum (1) is equal to the outer diameter of the roll of flexible membrane (2) on the rod (6), then the torque applied by the line member is perfectly balanced by the torque applied by the distributed net force in the flexible membrane (2) and there is no tendency for the system to move in any direction except by the application of an external force applied somewhere in the system (either by a persons hand or foot or by electrically powered device). In this situation, the resultant Force C in the line member (5) is equal to the force (tension) in the flexible fabric (2). In the absence of any external force being applied to the system, friction will overcome the low inertia of the system and the stile member (8) will stop moving smoothly after being released.

If the diameters of the drum on which the line member is wound, or the diameter of the roll of the flexible membrane are not matched, then a resultant torque is applied to the rod member (6) and then the system will be biased to move in one direction by the release of the potential energy stored in biasing means (3) and the unit will tend to move in one direction—either rolling up onto the rod (6) or further deploying across the aperture towards the pulleys (7) around which the line members 5*a* and 5*b* pass. The direction of movement is determined by the relative diameters. If the effective diameter of the drum is the lesser, then the line member (5) will tend to wind onto it, but if the roll diameter on the rod (6) is lesser, then the flexible fabric will tend to roll onto the rod.

FIG. 8.

Preferred Embodiment of a Double Unit

Figure 7:
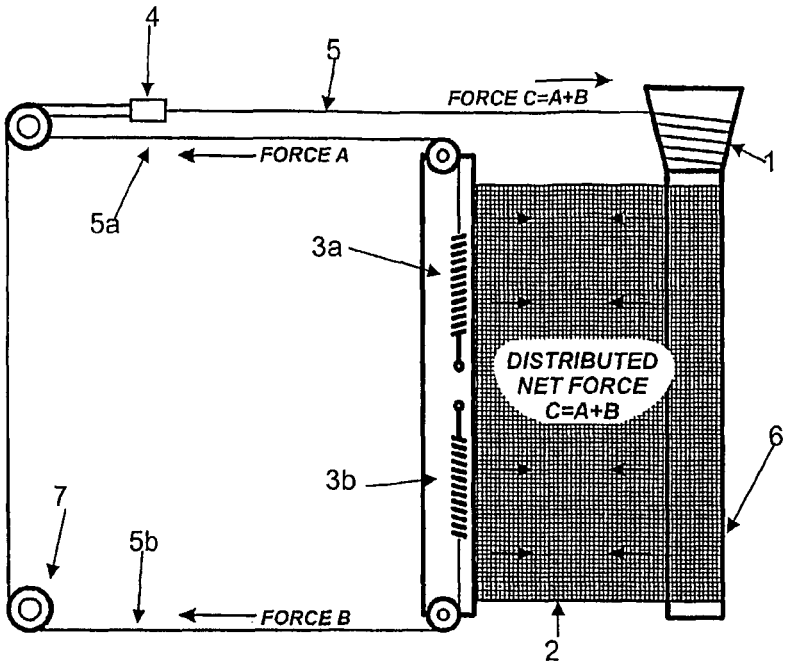
FIG. 7. Illustrates schematically a screen assembly containing a line member, pulleys, springs etc.

This is simply a combination of a unit as shown in FIG. 7 and a mirror image of the same unit. Such a double unit can be used to cover an opening (or aperture or space) twice as wide as can be covered by a single unit. The opposing vertical stile members (8) can meet at any point where they can latch together by any means—such as the use of magnetic strips or mechanical latching devices.

FIG. 9.

The preferred biasing means from FIG. 7 (tension springs) which were used to impart a tension in the system have been replaced by hanging weights. This system will work effectively, but will be constrained because the maximum deployment width of the flexible membrane (2) is equal to or less than the overall height of the unit in most practical situations. Only if the weights are allowed to fall below the bottom of the aperture can a greater width of operation be achieved. An additional shortcoming may be that the mass of the suspended weights must be accelerated when initiating or stopping the vertical stile member (8). The forces can still be in equilibrium in a balanced system.

FIG. 10.

One of the springs from the preferred embodiment has been moved from the moveable vertical stile member to a different (static) location.

FIG. 11.

One spring is used instead of two as shown in the preferred embodiment. This system will work effectively, but the ability to apply differential tensions at the top and bottom of the moveable vertical stile member (8) is now lost, and the entire system is tensioned at one time. An additional variation on this means would have the center point of the biasing member (3) fixed to the vertical stile (4) which would in effect allow the two ends to act independently of each other.

FIG. 12.

Figure 11:
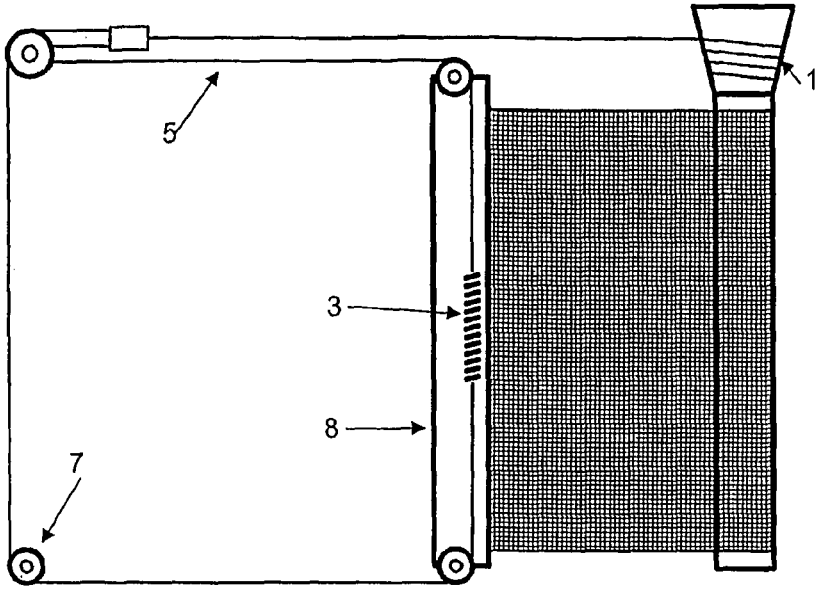
FIG. 11. Illustrates schematically an embodiment of the invention using a single spring.

Similar in principle to FIG. 11 except that a pulley (9) is attached to either end of the biasing member (3) inside vertical stile member (8). This has the effect of halving the travel of the biasing member (3) to compensate for any system imbalance, but requires additional components and room for them to be housed in the vertical stile member (8).

FIG. 13.

Similar to the unit in FIG. 7 except that the line member 5*b* is returned up through the vertical member (8). This configuration would be useful where an opposing jamb was not able to be used to hide the cable in.

FIG. 14.

Figure 12:
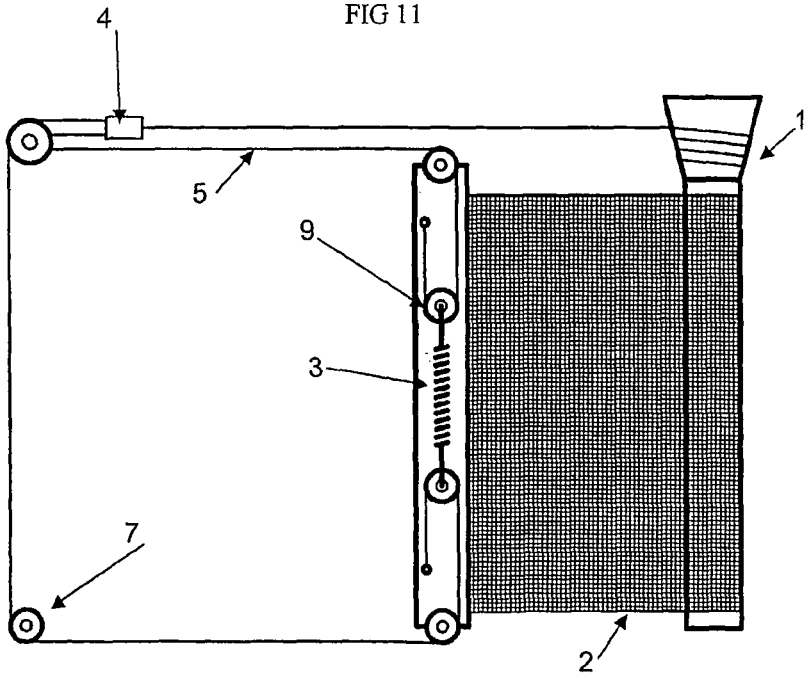
FIG. 12. Illustrates schematically an embodiment similar to that described with reference to FIG. 11 but showing a different pulley arrangement adjacent the single spring.
Figure 13:
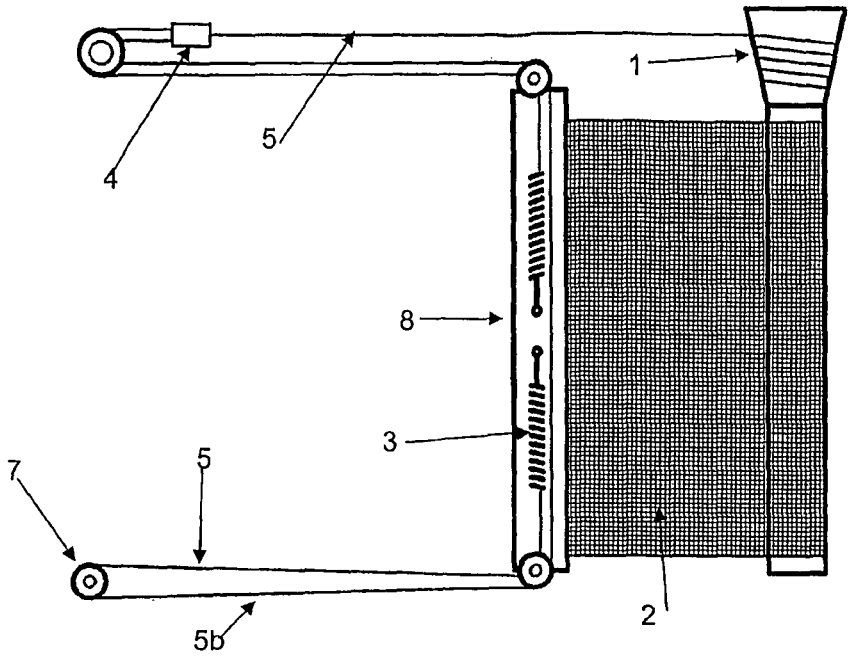
FIG. 13. Illustrates schematically an embodiment similar to that described with reference to FIG. 7 but showing a different positioning of the line member.
Figure 14:
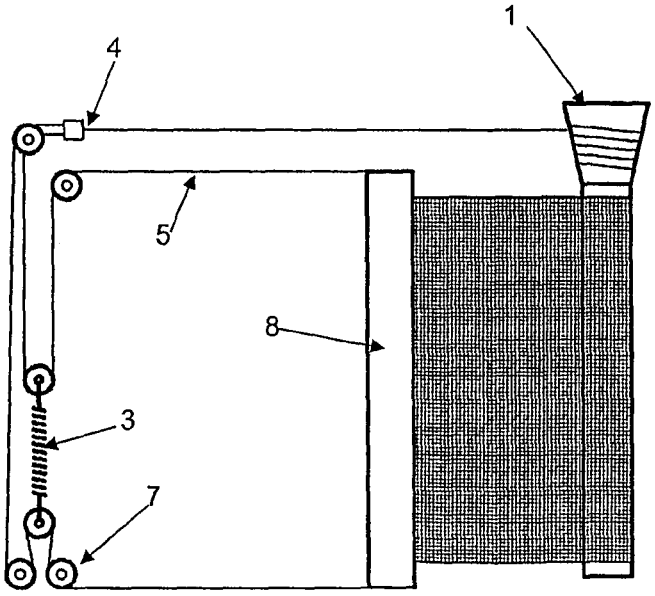
FIG. 14. Illustrates schematically an embodiment similar to that described with reference to FIG. 7 but showing the spring in a different position.
Figure 15:
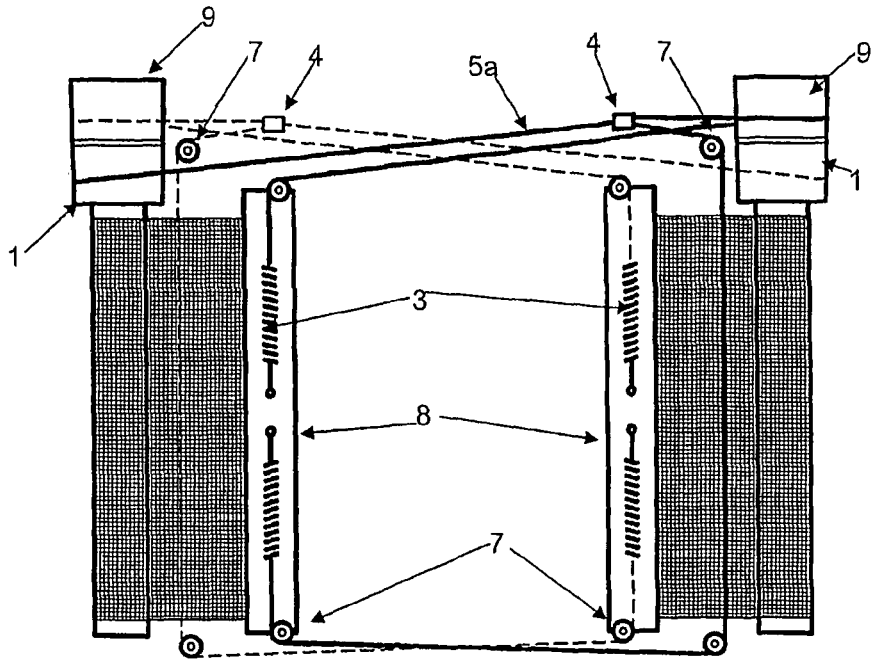
FIG. 15. Illustrates schematically a double unit according to another embodiment.
Figure 16:
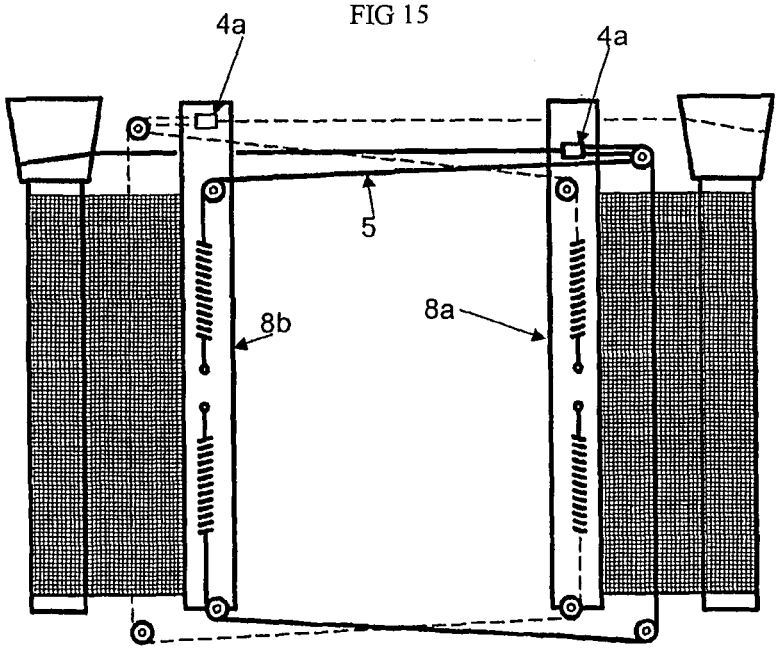
FIG. 16. Illustrates schematically a double unit according to another embodiment of the invention and illustrating the use of a pair of drums on each unit.

Similar to the unit in FIG. 7 except that the biasing means has been moved to the opposing jamb instead of being contained inside the moveable vertical stile member (8). The biasing means (3) is in this instance shown as a single device with a pulley at either end as described in FIG. 12.

FIG. 15.

Figure 8:
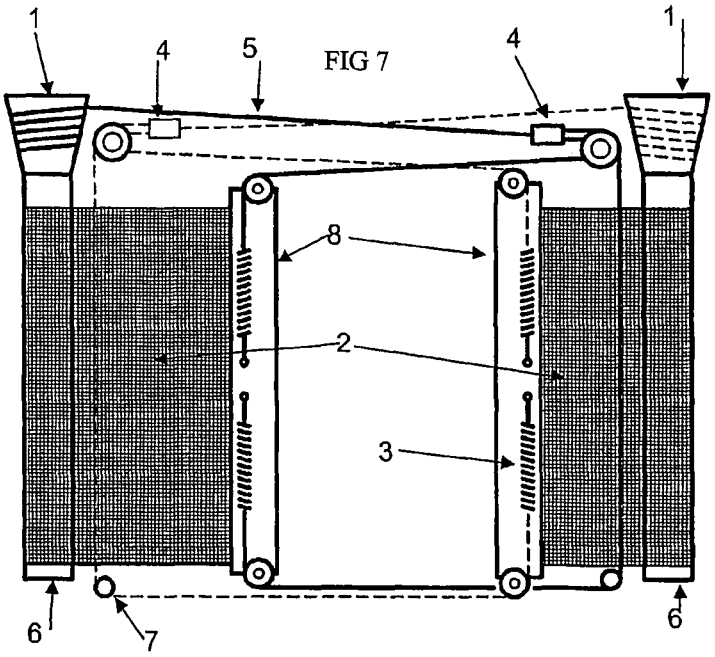
FIG. 8. Illustrates schematically a double screen assembly.
Figure 9:
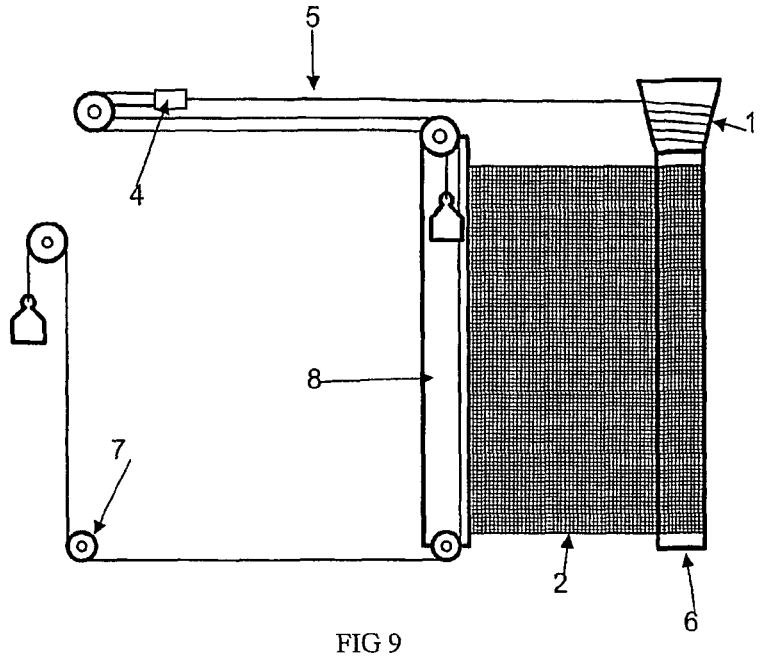
FIG. 9. Illustrates schematically an embodiment of the invention using a counterweight.
Figure 10:
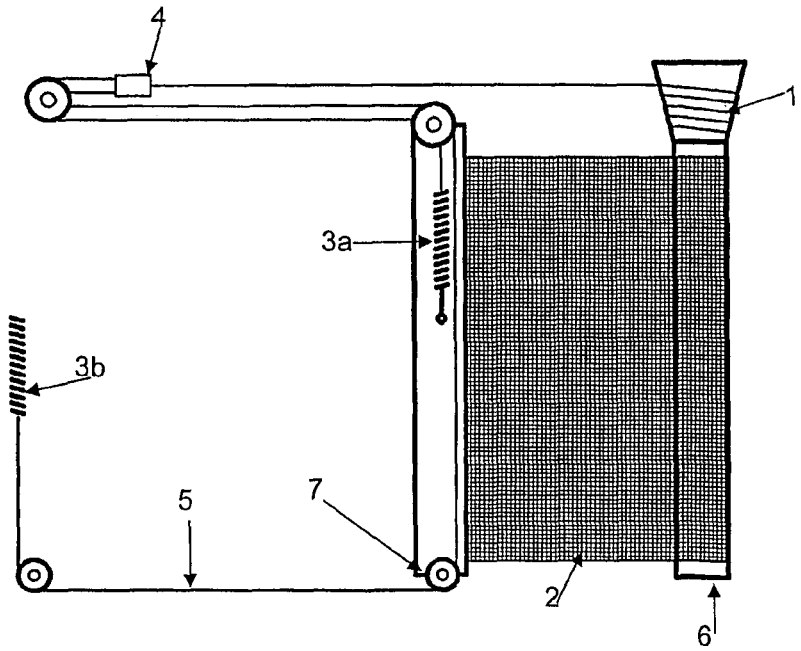
FIG. 10. Illustrates schematically an embodiment of the invention showing a different arrangement of springs.

Similar to the preferred embodiment of a double unit (refer FIG. 8.) (5*a*) returns around a pulley (9) mounted atop the drum (1) instead of pulley (7) located adjacent to the drum. This embodiment has the advantage of keeping line member (5*a*) as high as possible avoiding possible problems with crossover with other cables, but has the disadvantage of adding additional height to the unit above the top line of the flexible membrane.

FIG. 16.

Similar to the preferred embodiment of a double unit (refer FIG. 8) except that the joiner block (4*a*) is attached to the top end of the opposing vertical stile member (8*b*). The effect of this is to force the 2 vertical stile members (8*a* and 8*b*) to work in unison, such that moving stile 4*a* to the right causes stile 4*b* to move an equal distance to the left—and vice versa.

FIG. 17.

Figure 17:
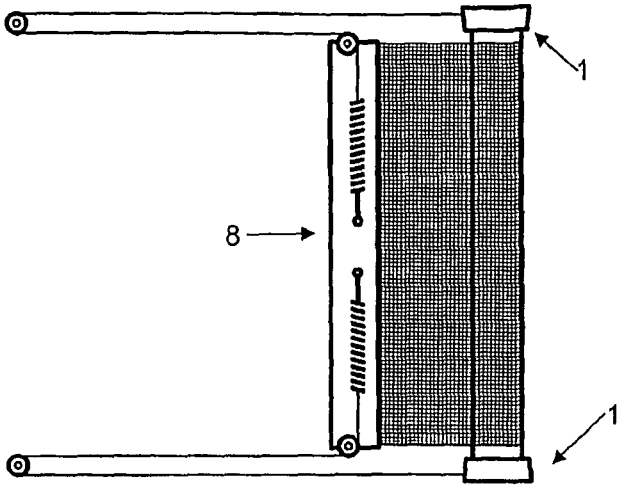
FIG. 17. Illustrates schematically an assembly similar to that described with reference to FIG. 7 but showing an upper and lower drum arrangement.
Figure 18:
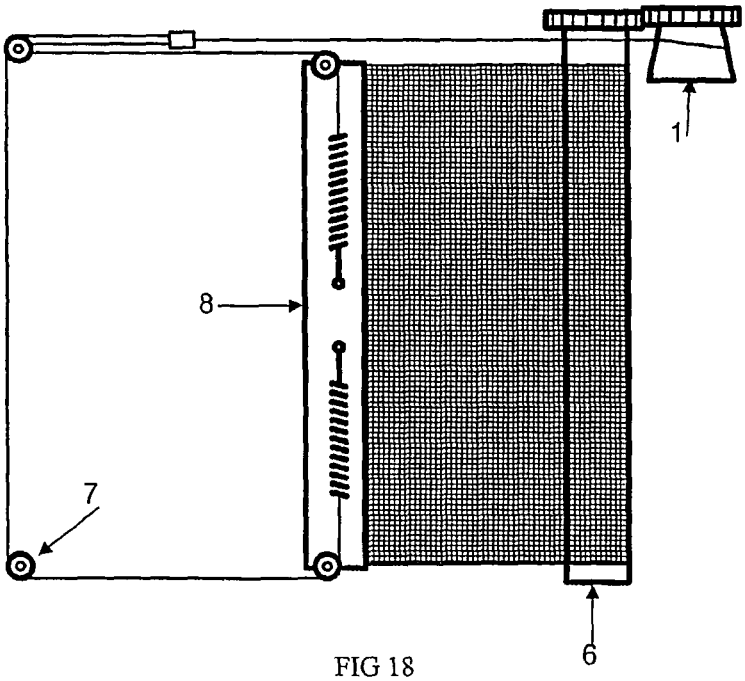
FIG. 18. Illustrates schematically an assembly similar to that described with reference to FIG. 7, but illustrating an "offset" upper drum.
Figure 19:
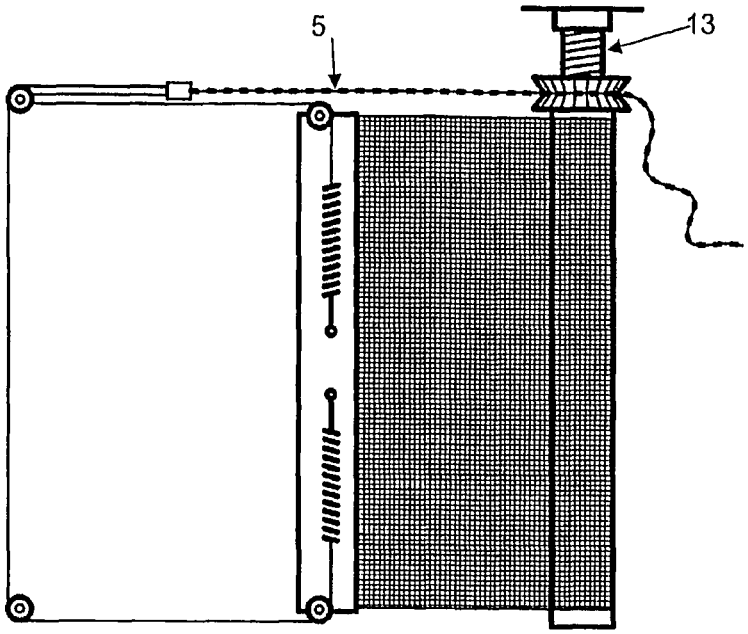
FIG. 19. Illustrates schematically an assembly similar to that described with reference to FIG. 7, but showing the use of a "operating member" to operate the line member but where the line member is not wound about the operating member.
Figure 20:
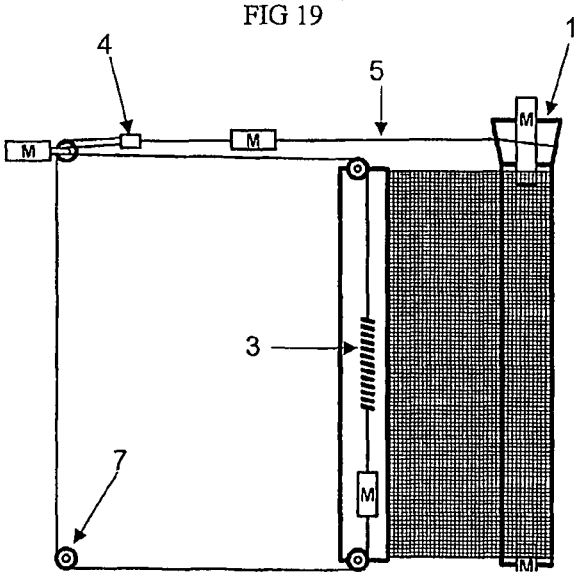
FIG. 20. Illustrates schematically a motorised unit and showing the different positions where the motor could be positioned.
Figure 21:
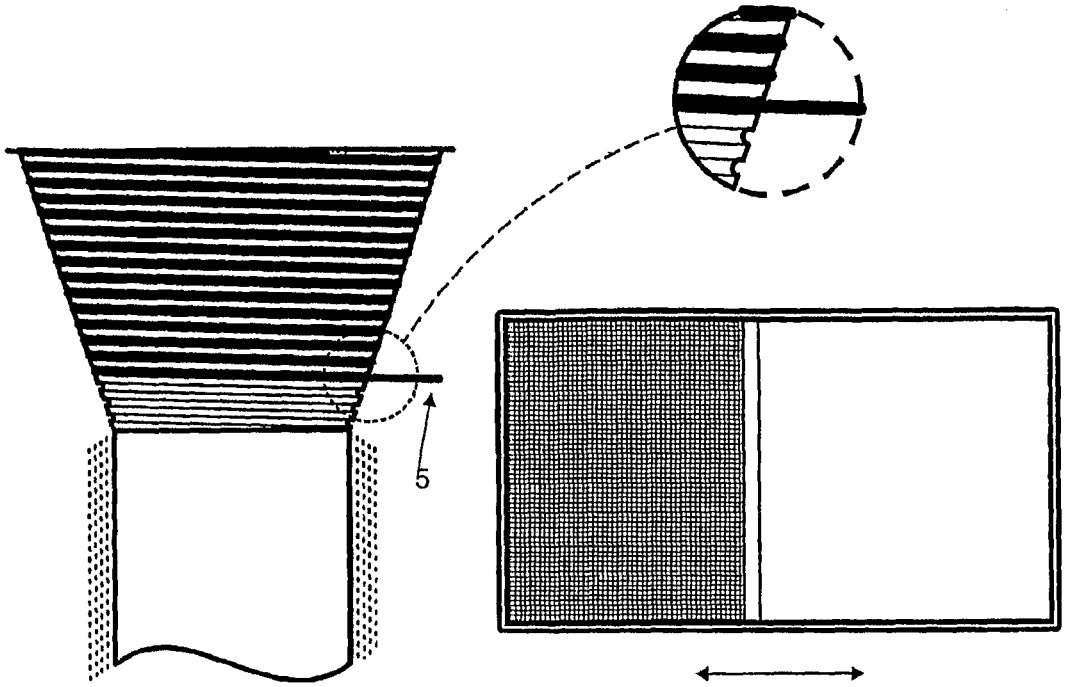
FIG. 21. Illustrates schematically a preferred drum.
Figure 22:
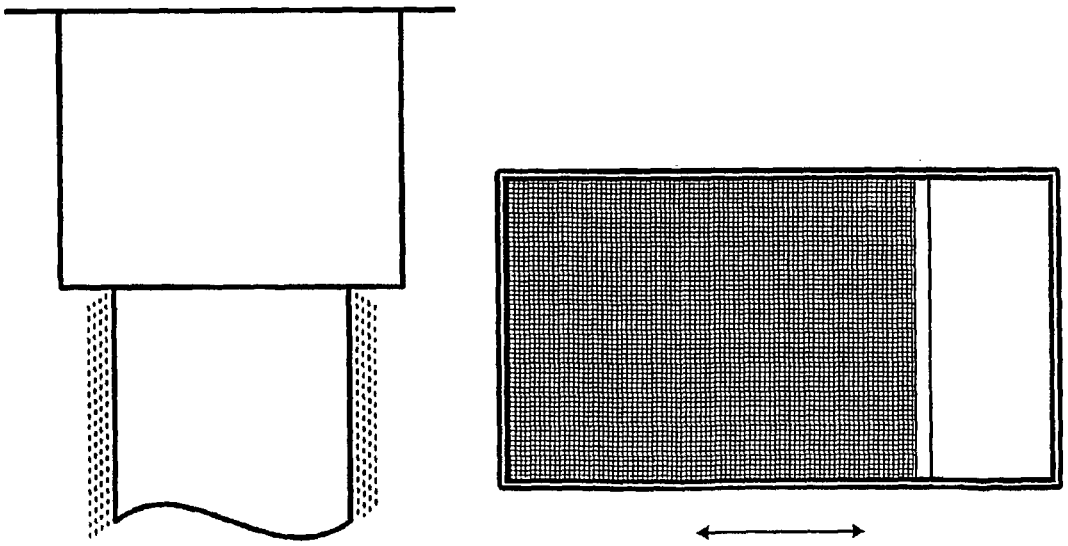
FIG. 22. Illustrates schematically a drum which is cylindrical.
Figure 23:
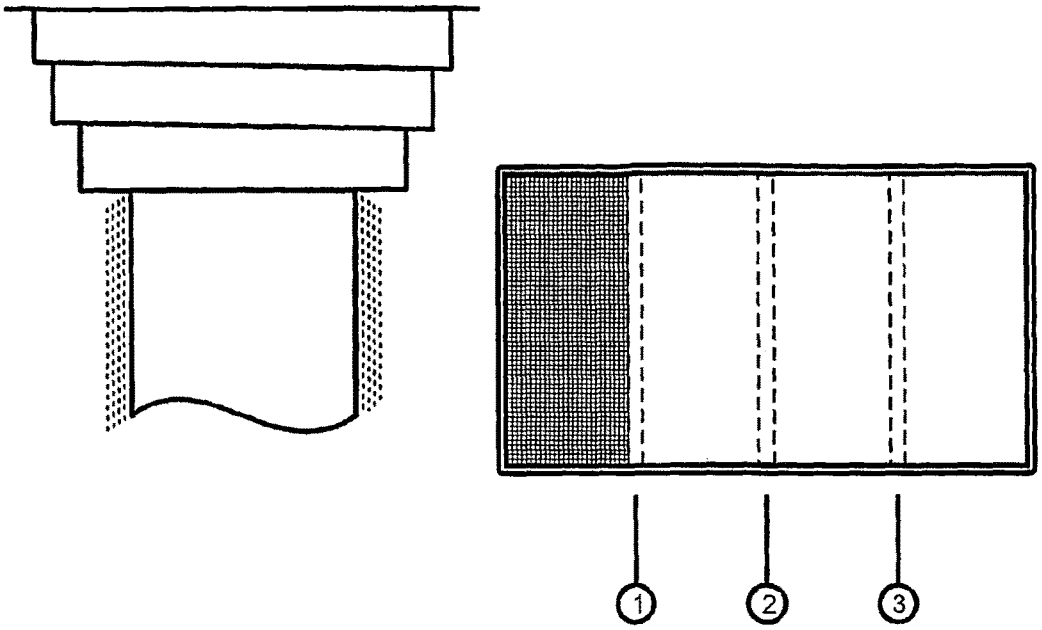
FIG. 23. Illustrates schematically a drum having a "stepped" cylindrical profile.
Figure 24:
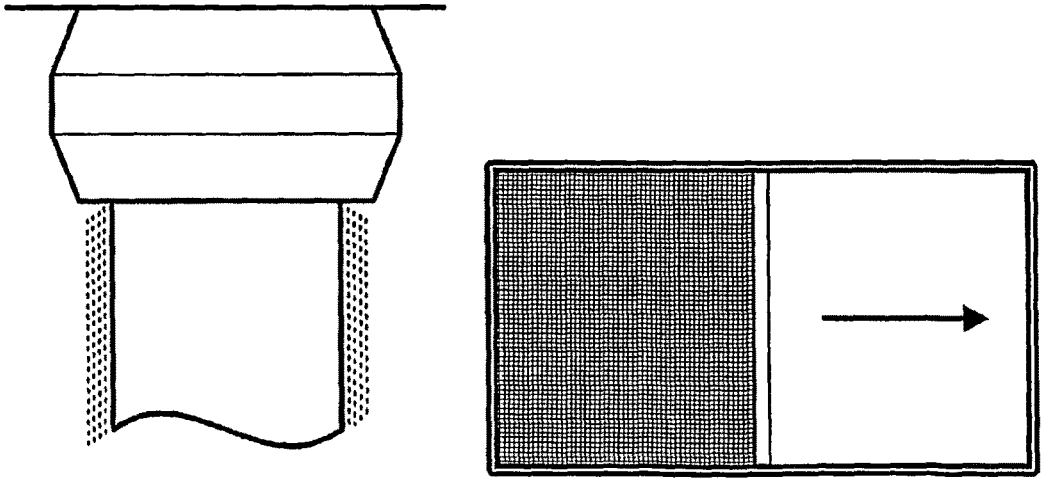
FIG. 24. Illustrates schematically a drum having a tapered cone at either end with a parallel portion in the centre.
Figure 25:
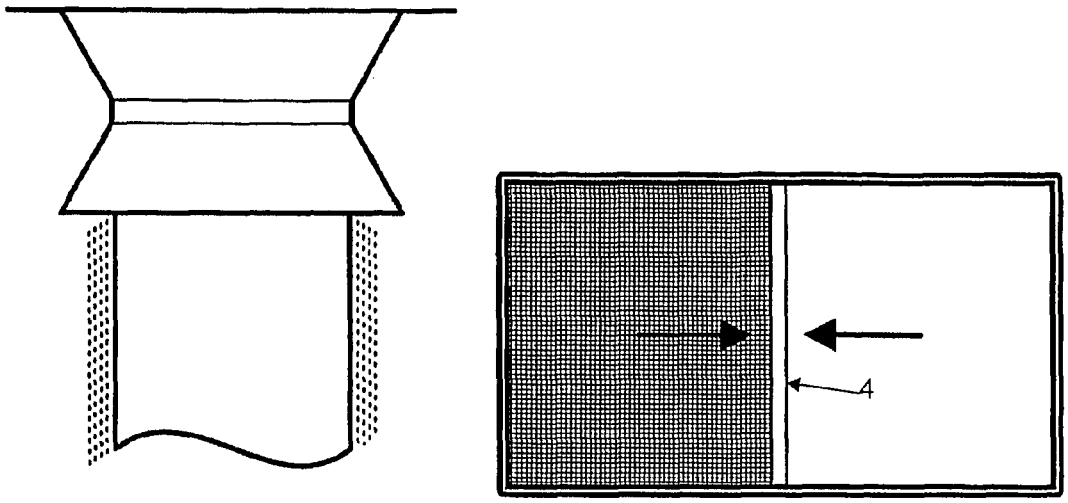
FIG. 25. Illustrates schematically a drum in the shape of a reverse barrel.
Figure 26:
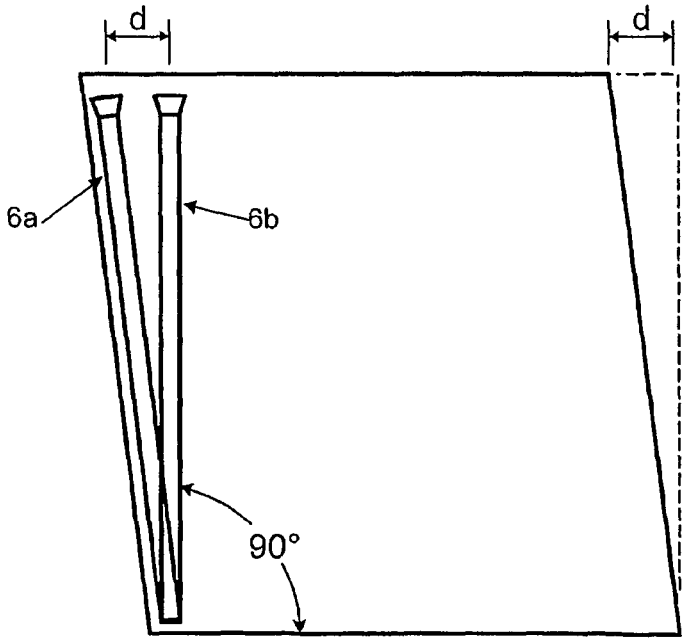
FIGS. 26-30. Illustrate, inter alia, lateral adjustment of the assembly.
Figure 27:
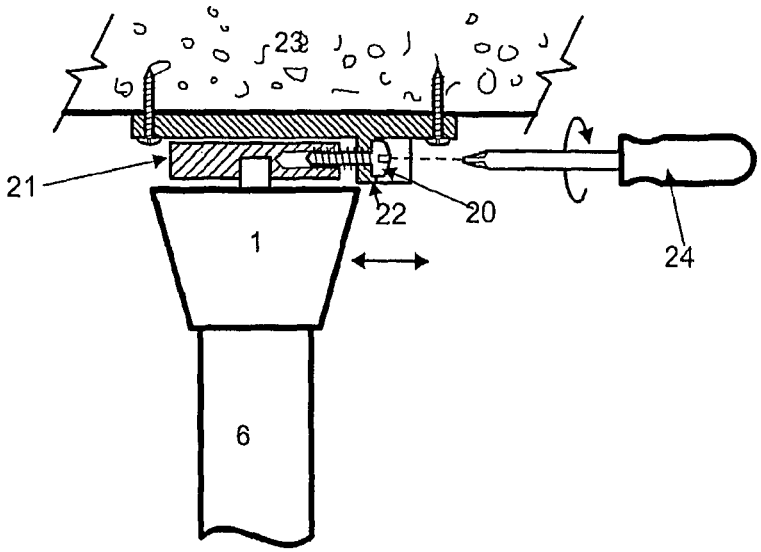
Figure 28:
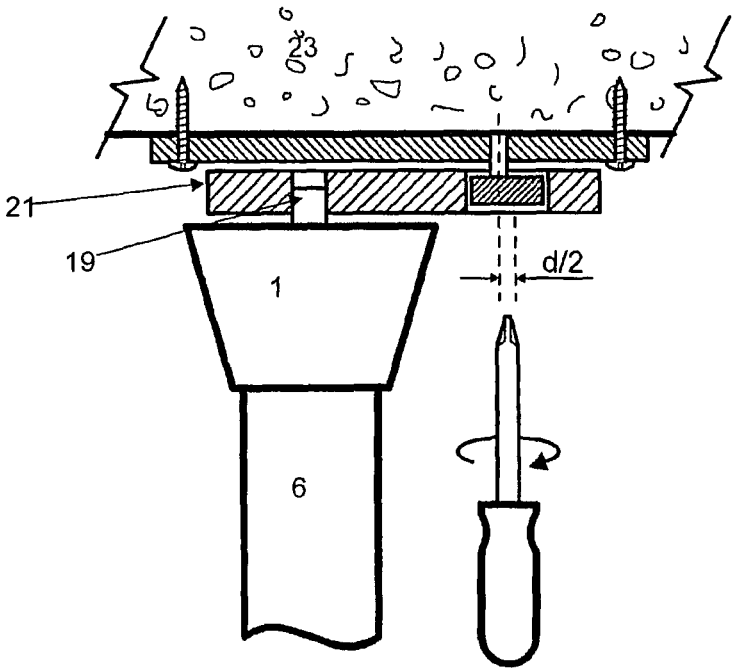
Figure 29:
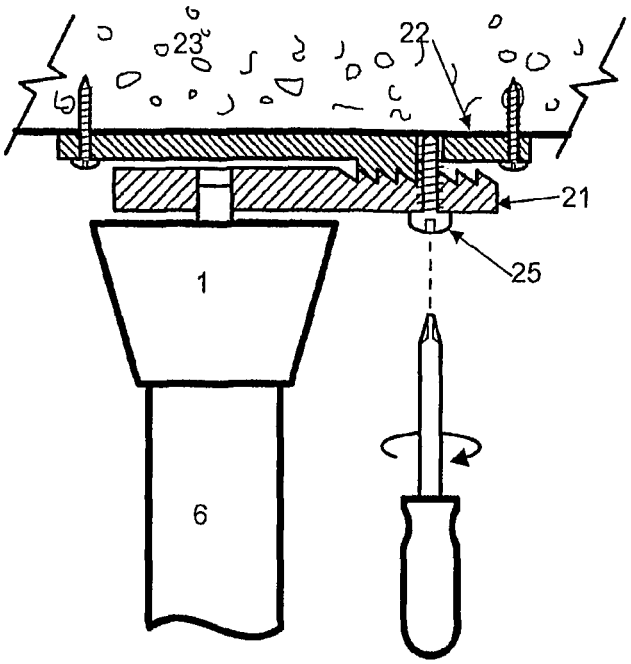
Figure 30:
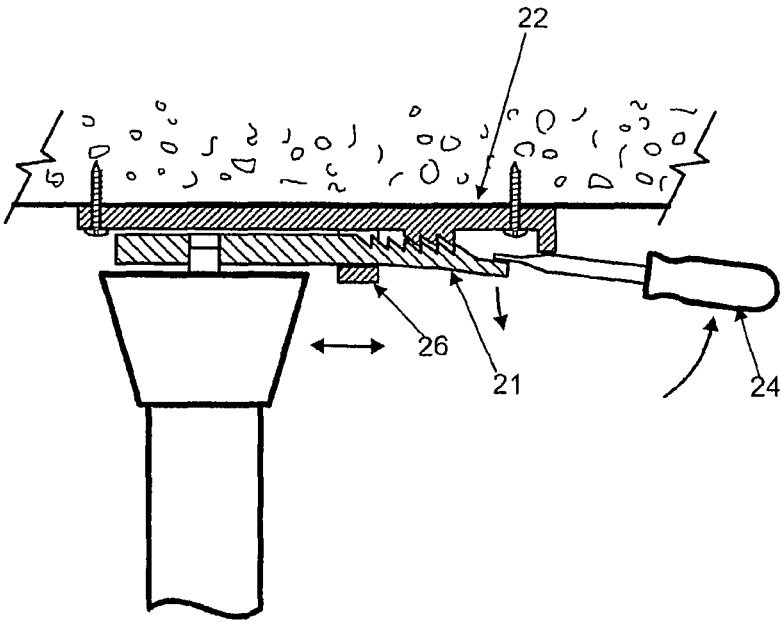

Similar to the preferred embodiment (FIG. 7) of a single unit, except that there is a drum at both the top and bottom of the rod member (6) onto which the flexible membrane is rolled. The top line member (5*a*) is wound onto the top drum and the bottom line member (5*b*) is wound onto the bottom drum. This embodiment has the advantages of not having to join cables together and not having to take the cable up the opposing end of the aperture. A disadvantage of this method is that a drum must be located at or below the bottom of the flexible membrane—which is generally a dirty area and one where additional room particularly if it increases overall height) is very scarce. The arrangement of FIG. 17 will usually not form part of the present invention.

FIG. 18.

Similar to the preferred embodiment (FIG. 7) of a single unit except that the drum member has been moved away from the preferred location on top of the vertical rod member (6) to some other location. The drum unit (1) is mechanically connected to the rod member (6) by gears, a chain, belt or some other drive means which induce the drum to turn whenever the rod member turns due to movement of the vertical stile member (8). It is also possible to drive the drum mechanism via the line member in a similar configuration. Being able to accumulate the line member in a location removed from the immediate area of the rod member 6 may allow for better utilization of space.

FIG. 19.

Similar to the preferred embodiment (FIG. 7) except that instead of the line member (5) being wound onto a drum (which is somewhat bulky), the line member could pass through a mechanism on top of (or somehow connected to) the rod member 6 which controls the rate of feed of the line member. Use of a line member made from ball chain (balls attached to a cord) would provide an easy means for controlling such feed—the ball chain could pass through a sprocket arrangement that ensured positive feed in either direction. The line member would be in tension on one side of the sprocket, but would not need to be after exiting the sprocket (as indicated) and could be accumulated elsewhere by any means—even simply falling down inside a tubular cavity inside the rod (6) or into some other cavity. It is further possible that the diameter of the sprocket could be changed as the rod (6) rotates by driving one side of the sprocket relative to the other side by means of a threaded mechanism (13) into a threaded block (14), this could enable the manipulation of relative feed rates to either create a constantly balanced system or some different effect.

FIG. 20.

Illustrates an automated or motorised screen assembly and particularly illustrates various places where the motor M can be placed.

FIGS. 21-25 illustrate various drum configurations.

Winding the line member onto the drum or cone in a controlled manner gives a very predictable outcome in operation of the system. If the winding on is uncontrolled, then the line member may become trapped amongst other wraps causing it to catch and drag upon unwinding.

FIG. 21.

This is the most preferred embodiment. The line member is a nylon coated stainless steel cable of small diameter (about 1 mm) which is wound onto a conical shaped drum member. The drum member does not have a smooth face, but rather has a spiral thread detail cut into it such that the line member has a continuous groove to lay into.

This groove serves two functions:

1) It eliminates the tendency for the line member to slip towards the smaller diameter of the tapered cone; and
2) It precisely controls the position of the line member on the cone such that it is guided into the groove by the angled sides of the groove itself eliminating the need for a feeding device (such as in some fishing reels and other bobbin winders) to control the distribution of the cable onto the surface of the drum. This is made possible because there is only ever 1 layer of cable on the drum.

As the vertical stile is moved away from the rod onto which it was furled (deploying more of the membrane across the aperture), a length of cable (5) is wrapped onto the drum. With each wrap of the line member onto the cone, the effective diameter of drum in which the groove is recessed, decreases by the same amount as the diameter of the roll of flexible membrane has decreased. If this relationship is largely identical, then the system can be said to be balanced, no extension or contraction of the biasing means (3) will result as the vertical stile member is moved from one position to another, and the stile member will have no tendency to move from any position in which it is left.

FIG. 22.

The drum shape is a simple cylinder. The line member is a simple cord or wire and wraps side by side on the drum (no building of the effective diameter of the drum caused by multiple layers of line member). At only one position in the travel of the vertical stile member can the effective diameter of the roll of flexible membrane be equal to the effective diameter of the line member wrapping onto the drum, and only at this one location will the system be 'balanced'. As the vertical stile member is moved away from the balance position the biasing means (3) are extended (which requires the input of energy), so the tendency of the system is to always move towards the balanced point—the lowest energy state.

FIG. 23.

The drum shape is multiple cylinders of different diameters (e.g. "stepped"). As the line member wraps along the drum it steps from one effective diameter to the next. The resultant outcome is that it is now possible to have multiple positions at which the system can be said to be balanced. This configuration may have a difficulty of controlling the line member across the transition from one diameter to the next.

FIG. 24.

The drum shape has a tapered cone at either end, and possibly a short parallel portion at or about its centre. Another similar shape may be a barrel shape. The effect of this shape of drum would be to have a single point or zone near the middle of the range of travel where the system is balanced, and outside of this zone the system will be biased towards being fully deployed or fully closed. This may be an ideal situation where the screen self closes within the normal range of operation, has a balanced zone at which the screen can be temporarily left with no need to hold it in this partly open position, but upon initiating putting the unit away for storage, it actually self retracts.

FIG. 25.

The drum shape is a reverse barrel. The result would be the strong tendency for the vertical stile member (4) to move toward the neutral position somewhere near the middle of the aperture.

Lateral Adjustment

A door frame (or similar frame for other purposes) is usually manufactured in a factory from 4 basic linear members cut to length and fixed together at 4 corners. It is generally possible to manufacture the frame as a fairly accurate rectangle. When it is taken to a building site and installed into its intended position, however, the reality is that the largely vertical jamb members are just that—largely vertical. In fact it is quite common for the vertical members to be up to 5 mm or more out of vertical, it will be appreciated that with large door frames it is difficult to achieve a better result without much time and care.

FIG. 26

A parallelogram is shown to represent an installed door frame which has side jambs that are out of vertical by a distance 'd', where the corners are substantially out of square. A simple means of adjusting the position of rod element (6) from position (6*a*) where it is largely parallel to the frame edge by a compensating distance 'd' to position (6*b*) where it is ideally vertical at least in this one plane, is desirable.

FIG. 27

A screw adjustable mechanism is illustrated where the assembled unit of drum (1) and rod member (6) are attached to a block member (21) via a pin or bearing member (to enable rotation of the drum and rod assembly) which is has at one position a tapped hole or recess into which is engaged a threaded bolt or screw member (20), some part of which is engaged into a secondary block member (22) which is in turn fixed to the door frame (23). The bolt (20) can be attached to block (22) in such a way that it has only one degree of freedom with respect to block (22)—it can rotate. Rotation of the bolt (20) will cause the threaded portion of it which is engaged into block (21) to induce a linear movement of block (21) along the axis of the bolt—as indicated by the double headed arrow. A screw driver (24) or similar instrument (Allen key etc) can the be used as a simple means of adjusting the assembly to a substantially vertical position.

FIG. 28

A cam mechanism is used to drive the relative positions of blocks (21) and (22) instead of a threaded screw or bolt. A cam with 2 substantially round surfaces with axis offset by a distance d/2, will induce relative movement of distance 'd' by turning through an angle of 180 degrees.

FIG. 29

A screw (25) is used to fix block (21) to block (22)—with one or both of these blocks having a slotted hole which allows movement along the desired axis of adjustment travel, when the screw (25) is loosened. Some engaging means (such as serrated teeth or grooves) in the two blocks will ensure positive location when the fixing screw (25) is tightened, but this is not absolutely necessary—friction between the 2 mating blocks may be sufficient.

FIG. 30

A restraining device (26) is used to maintain engagement between 'teeth' on block (21) and a mating set of 'teeth' on block (22). To release the engagement, a levering device (24) is used to flex a bendable portion of block (21) away from block (22) so that the teeth are disengaged and relative movement is enabled.

Figure 31:
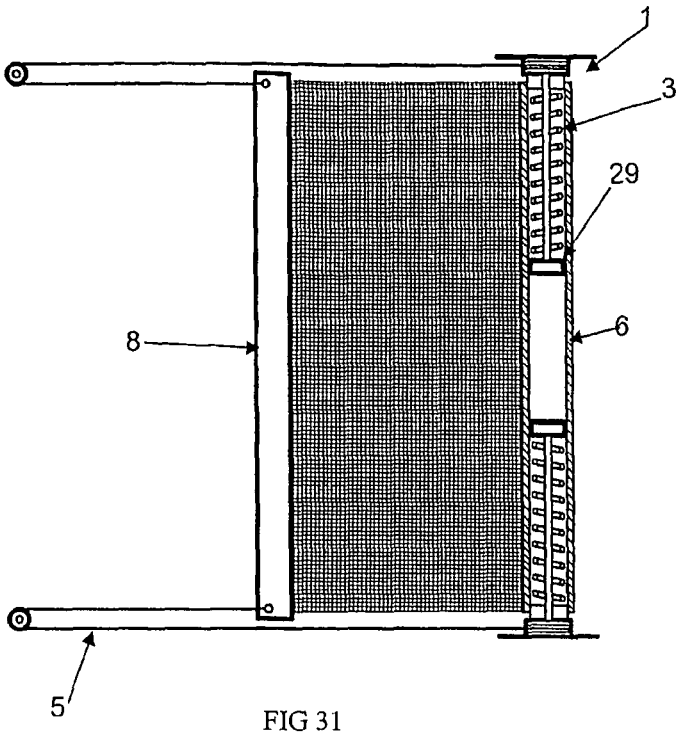
FIG. 31. Illustrates the use of a spring inside the fabric supporting rod.

Referring now to FIG. 31, there is illustrated a screen assembly and particular emphasis, in this figure is placed on the rod member 6. In FIG. 31, there is illustrated a torsion spring 3. One end 29 of the spring is attached to a tubular rod member 6. The other end 28 of the spring is attached to the rod member and to the drum 1 such that drum 1 is able to rotate relative to rod member 6 about a common axis. Such relative rotation will induce torsion into the spring.

The system can be pretensioned with a linear spring in other embodiments with a difference that any differential length of winding fabric 2 and line member 5 as the vertical stile member 8 is moved, will be absorbed by relative rotation of the drum 1 to the rod member 6.

Figure 32:
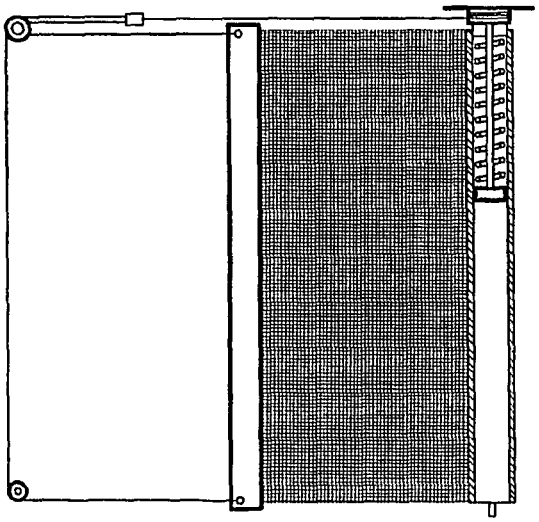
FIG. 32. Illustrates a variation to FIG. 31.

FIG. 32 illustrates a similar system with a cable joiner and just one drum at either the top or the bottom of the rod member 6.

Figure 33:
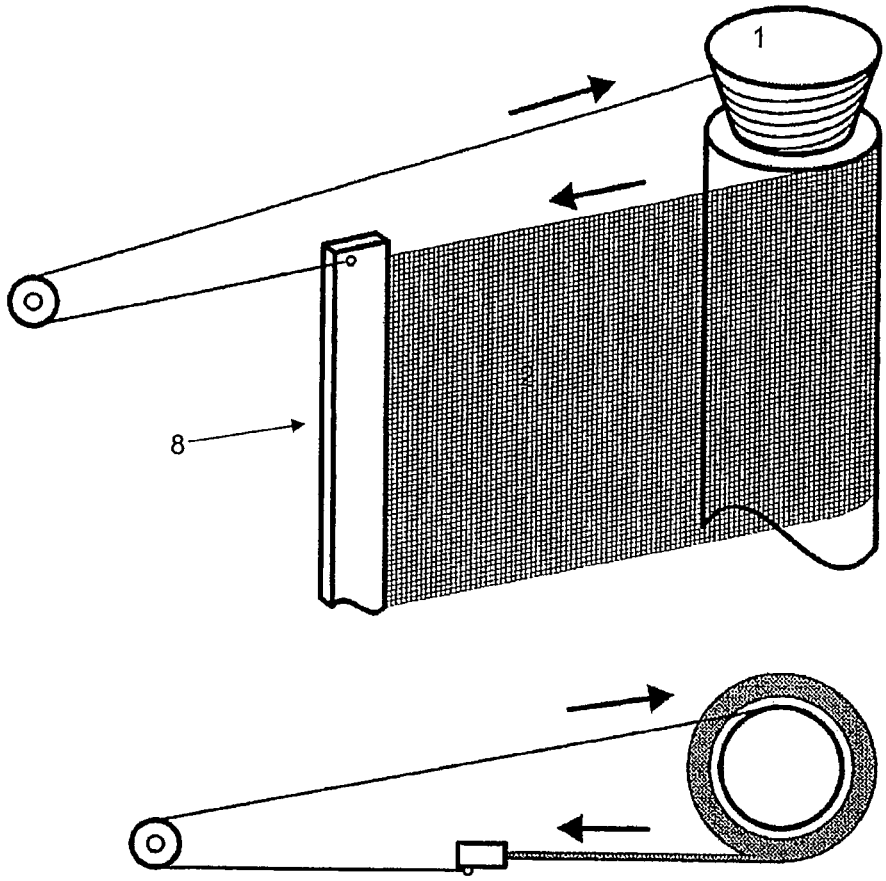
FIG. 33. Illustrates another embodiment of the invention.
Figure 34:
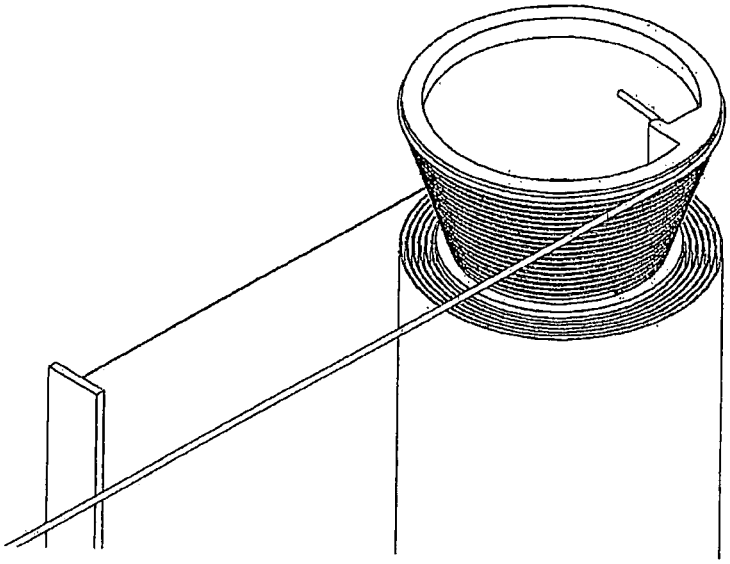
FIG. 34. Illustrates operation of the mechanism.
Figure 35:
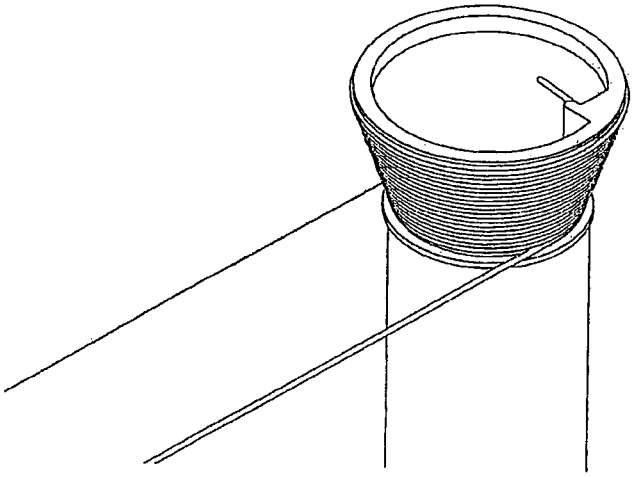
FIG. 35. Illustrates operation of the mechanism.

FIG. 33 more clearly illustrates that as the drum 1 is fixed to rod 6, the drum and the rod turn together. Thus as the flexible membrane 2 comes off one side of its roll, the line member 5 rolls onto the opposite side of the drum 1. This may be the case in the previous embodiments.

It will be appreciated that there are other means for controlling the relative positioning of the end of the rod or tube onto which the fabric are rolled with respect to the frame. It will further be appreciated that this adjustment could be done at the top or at the bottom of the rod or tube assembly—or indeed both.

Some other parts of the present invention which are considered to provide desirable features to the invention are as follows:

1. Springs in the stile (not tube)
   a. Separate spring adjustment for top and bottom of screen
   b. Easy access for initial adjustment during installation and also for readjustment if required c. Easy for the installer to visualize the function of each component and how it is performing—he can see if the elements move as they are supposed to etc.

2. Cable aligned with cloth to eliminate torque on stile
3. Cables offset and at different heights so they don't clash on a double screen unit
4. Lateral screw adjustment for jambs out of plumb
5. Framing system integral with door & screen
6. Spring tension (biasing means), combined with the Balanced force provides a safe (no recoil, very little inertia) cushioning system against human impact
7. Lateral adjustment.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A screen assembly comprising:

a substantially vertical flexible screen having a front edge area, a supporting member about which the screen can be wound/unwound and which is substantially vertical and has an upper end and a lower end, a biasing means associated with the supporting member to create a tension in the screen to bias the supporting member to a wound condition, a single drum/pulley supported upon at least one end of the supporting member, the single drum/pulley is configured as a cone and comprising a first end and a peripheral circumference that tapers diametrically from the first end to a smaller second end, the smaller second end more proximate the screen and the cone configuration being aligned vertically with the supporting member along the second end to the first end of the single drum/pulley, a line member that can be wound onto and off the single drum/pulley, the line member being operatively associated with the screen such that as the screen is extended, the line member is wound onto the single drum/pulley, and as the screen is retracted, the line member is wound off the single drum/pulley, the screen, when wound about the supporting member, having a diameter which increases as the screen material is wound about supporting member, and which decreases as the screen material is unwound from the supporting member, the diameter of the single drum/pulley, at the position where the line member winds onto the single drum/pulley or off the single drum/pulley, being about the same diameter of the supporting member containing the screen, the line member being operatively attached to the front edge area of the screen, the line member comprises:

a first part which winds onto and off the single drum/pulley, a second part which is attached to the first part via a joiner block, the second part being operatively connected to an upper front edge area of the screen, and a third part which is attached to the first part via the joiner block, the third part being operatively connected to a lower front edge area of the screen, the joiner block mounting the second part and the third part to the first part;

at least one return pulley for guiding the second part and the third part around the at least one return pulley; and wherein the line member is configured such that the joiner block moves in an opposite direction to the direction of movement of the front edge area of the flexible screen, and a pair of balancing biasing means to create a balanced tension in the substantially vertical screen, a first balancing biasing means mounted to the front edge area of the screen at a first mounting point and attached to the second part of the line and a second balancing biasing means mounted to the front edge area of the screen at a second mounting point and attached to the third part of the line, the pair of biasing means independent of one another.

2. The assembly of claim 1, wherein the biasing means to create a tension in the screen is operatively attached to the front edge area of the screen, and the line member is operatively attached to the biasing means.

3. The assembly of claim 1 wherein the line member is configured to be wound over the drum/pulley from proximate the smaller second end toward the larger first end during the unwinding of the screen from over the supporting member.

4. The assembly of claim 1 wherein the drum/pulley comprises a peripheral circumference and a groove spiraling around the peripheral circumference, the groove configured to receive portions of the line member.

5. The assembly of claim 1 wherein the line member comprises a single line only that is wound and unwound over the drum/pulley during the selective unwinding and winding of the screen.

6. The assembly of claim 1 wherein the line member comprises:

a single line structure;

a double line structure; and wherein the joiner block connects the single line structure to the double line structure.

7. The assembly of claim 1 wherein the front edge area of the flexible screen comprises a top portion opposite a bottom portion, the top portion comprising a first pulley and the bottom portion comprising a second pulley, and further comprising:

a first return pulley laterally spaced from the drum/pulley, the first return pulley having the radially outer guide and the radially inner guide;

a second return pulley diagonally spaced from the drum/pulley; and wherein the line member is operatively secured over the first return pulley and the second return pulley.

8. The assembly of claim 1, comprising a stile attached to the front edge area of the screen.

9. The assembly of claim 8, wherein the biasing means to create a tension in the screen is attached to the stile.

10. The assembly of claim 9, wherein the biasing means comprises at least one spring, one end of which is attached to the stile, and the other end of which is attached to the line member.

11. The assembly of claim 10, the at least one spring comprising: a first spring attached to the second part of the line member in an upper part of the stile, and a lower spring attached to the third part of the line member in a lower part of the stile.

12. The assembly of claim 11, wherein the biasing means is attached to the line member which is operatively attached to the upper edge area of the screen, and to the line member which is attached to the lower edge area of the screen.

13. The assembly of claim 11, wherein only the single drum/pulley is provided.

14. The assembly of claim 1 wherein the joiner block is located between the drum/pulley and a first return pulley.

15. The assembly of claim 14 wherein the second and third line members only are operatively secured over the first return pulley.

16. The assembly of claim 15 wherein the first line member only is operatively secured over a first return pulley.

17. The assembly of claim 16 wherein the drum/pulley is located on the upper end of the supporting member, and the first return pulley is located adjacent an upper end of an opposed end of a cavity in which the assembly is located to the drum/pulley.

18. The assembly of claim 17 wherein the assembly further comprises a second return pulley located adjacent a front edge of the screen, a third return pulley located adjacent a lower end of the opposed end of the cavity in which the assembly is located to the drum/pulley, and a fourth return pulley adjacent the front edge of the screen.

19. The assembly of claim 18 wherein the second line member is operatively secured over the second return pulley, and the third line member is operatively secured over the third return pulley and the fourth return pulley.

20. A screen assembly comprising:

a flexible screen having a front edge area, a supporting member about which the screen can be wound/unwound and which is substantially vertical and has an upper end and a lower end, a biasing means associated with the supporting member to create a tension in the screen to bias the supporting member to a wound condition, a single drum/pulley only and on the upper end of the supporting member, the single drum/pulley is configured as a cone and comprising a first end and a peripheral circumference that tapers diametrically from the first end to a smaller second end, the smaller second end more proximate the screen and the cone configuration being aligned vertically with the supporting member from the second end to the first end of the single drum/pulley, a line member that can be wound onto and off the single drum/pulley, the line member being operatively associated with the screen such that as the screen is extended, the line member is wound onto the single drum/pulley, and as the screen is retracted, the line member is wound off the single drum/pulley, the screen, when wound about the supporting member, having a diameter which increases as the screen material is wound about supporting member, and which decreases as the screen material is unwound from the supporting member, the line member comprising:

a first part which winds onto and off the single drum/pulley, a second part which is attached to the first part via a joiner block, the second part being operatively connected to an upper front edge area of the flexible screen, and a third part which is attached to the first part via the joiner block, the third part being operatively connected to a lower front edge area of the flexible screen, the diameter of the single drum/pulley, at the position where the line member winds onto the single drum/pulley or off the single drum/pulley, being about the same diameter of the supporting member containing the screen, the line member being operatively attached to the front edge area of the screen, a joiner block for combining two portions of the line member, the line member is configured such that the joiner block moves in an opposite direction to the direction of movement of the front edge area of the flexible screen, the joiner block for mounting the second part and the third part to the first part, and at least one return pulley for guiding the second part and the third part around the at least one return pulley; and a pair of balancing biasing means to create a balanced tension in the substantially vertical screen, a first balancing biasing means mounted to the front edge area of the screen at a first mounting point and attached to the second part of the line and a second balancing biasing means mounted to the front edge area of the screen at a second mounting point and attached to the third part of the line, the pair of biasing means independent of one another so that together, the pair of balancing biasing means balances the tension in the screen.

21. The assembly of claim 20, wherein the biasing means to create a tension in the screen is operatively attached to the front edge area of the screen, and the line member is operatively attached to the biasing means.

22. The assembly of claim 20 wherein the drum/pulley comprises a peripheral circumference and a groove spiraling around the peripheral circumference, the groove configured to receive portions of the line member.

23. The assembly of claim 20, wherein the front edge area of the flexible screen comprises a top portion opposite a bottom portion, and top portion comprising a first pulley and the bottom portion comprising a second pulley, and further comprising:

a first return pulley laterally spaced from the drum/pulley, the first return pulley having the radially outer guide and the radially inner guide;

a second return pulley diagonally spaced from the drum/pulley; and wherein the line member is operatively secured over the first return pulley and the second return pulley.

24. The assembly of claim 20, comprising a stile attached to the front edge area of the screen.

25. The assembly of claim 24, wherein the biasing means to create a tension in the screen is attached to the stile.

26. The assembly of claim 25, wherein the biasing means comprises a spring, one end of which is attached to the stile, and the other end of which is attached to the line member.

27. The assembly of claim 26, comprising a first spring attached to the second part of the line member in an upper part of the stile, and a lower spring attached to the third part of the line member in a lower part of the stile.

28. The assembly of claim 1 or 20, further comprising an adjustment assembly to adjust the angle of the supporting member.

29. The assembly of claim 28, wherein the adjustment assembly is a screw adjustable mechanism wherein the assembled unit of drum and supporting member are attached to a block member via a pin or bearing member to enable rotation of the drum and supporting member and which has at one position a tapped hole into which is engaged a threaded member, a part of which is engaged into a secondary block member which is in turn fixed to a door frame rotation of the threaded member causing the threaded portion to induce linear movement of the block member along an axis of the threaded member thereby enabling the supporting member to be adjusted to a substantially vertical position.

30. The assembly of claim 28, wherein the biasing means to create a tension in the screen is operatively attached to the front edge area of the screen, and the line member is operatively attached to the biasing means.

31. The assembly of claim 28, wherein only a single drum/pulley is provided.

32. The assembly of claim 28, comprising a stile attached to the front edge area of the screen.

33. The assembly of claim 32, wherein the biasing means to create a tension in the screen is attached to the stile.

34. The assembly of claim 33, wherein the biasing means comprises a spring, one end of which is attached to the stile, and the other end of which is attached to the line member.

35. A screen assembly comprising:

a supporting member extending vertically;

a flexible screen having a front edge area, the flexible screen being secured to the supporting member in a configuration to allow the screen to be selectively wound and unwound over the supporting member;

a drum configured as a cone, the cone comprising a first end and a peripheral circumference that tapers diametrically from the first end to a smaller second end, the drum is secured to the supporting member with the smaller second end more proximate the screen and the cone configuration being aligned vertically with the supporting member from the second end to the first end of the drum, the drum being the only drum secured to the supporting member; and a line member operatively secured between the drum and the screen in a configuration that allows the line member to be wound and unwound over the drum during the selective unwinding and winding of the screen, the line member comprising:

a first part which winds onto and off the drum, a second part which is attached to the first part via a joiner block, the second part being operatively connected to an upper front edge area of the flexible screen, and a third part which is attached to the first part via the joiner block, the third part being operatively connected to a lower front edge area of the flexible screen;

a joiner block for combining the second and third parts of the line member, the line member being configured such that the joiner block moves in an opposite direction to the direction of movement of the front edge area of the flexible screen, the joiner block mounting the second part spaced apart and parallel from the third part, and at least one return pulley having a radially outer guide for the third part and a radially inner guide for the second part to maintain the second part spaced apart, and parallel to, the third part around the at least one return pulley.

36. The assembly of claim 35 wherein the drum comprises a groove spiraling around the peripheral circumference of the drum, the groove configured to receive portions of the line member.

37. The assembly of claim 35 wherein the line member is configured to be wound over the drum from proximate the smaller second end toward the larger first end during the unwinding of the screen from over the supporting member.

38. The assembly of claim 35, wherein the front edge area of the flexible screen comprises a top portion opposite a bottom portion, the top portion comprising a first pulley and the bottom portion comprising a second pulley, and further comprising:

a first return pulley laterally spaced from the drum, the first return pulley having the radially outer guide and the radially inner guide;

a second return pulley diagonally spaced from the drum; and wherein the line member is operatively secured over the first return pulley and the second return pulley.

* * * * *